US011788555B1

(12) United States Patent
Rimmer

(10) Patent No.: US 11,788,555 B1
(45) Date of Patent: Oct. 17, 2023

(54) METAL COMPLIANCE RING-MOUNTED BEARINGS IN ELECTRIC SUBMERSIBLE PUMP MOTOR

(71) Applicant: Halliburton Energy Services, Inc., Houston, TX (US)

(72) Inventor: Michael Rimmer, Frimley (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/855,299

(22) Filed: Jun. 30, 2022

(51) Int. Cl.

| | |
|---|---|
| ***F04D 29/62*** | (2006.01) |
| ***F04D 13/08*** | (2006.01) |
| ***E21B 43/12*** | (2006.01) |
| ***F04D 29/046*** | (2006.01) |
| ***F04D 29/043*** | (2006.01) |

(52) U.S. Cl.
CPC ..... *F04D 29/628* (2013.01); *E21B 43/128* (2013.01); *F04D 13/086* (2013.01); *F04D 29/043* (2013.01); *F04D 29/0465* (2013.01)

(58) Field of Classification Search
CPC ..... F04D 13/086; F04D 13/10; F04D 29/628; F04D 29/0465; E21B 43/128
See application file for complete search history.

(56) References Cited

U.S. PATENT DOCUMENTS 5,209,577 A * 5/1993 Swatek ..... F16C 33/043 384/220
5,436,515 A 7/1995 Ide
6,091,175 A 7/2000 Kinsinger
6,566,774 B2 5/2003 Parmeter et al.
10,145,380 B1 * 12/2018 Davis ..... F04D 29/041
10,424,988 B2 9/2019 Delgado Marquez et al.
(Continued)

FOREIGN PATENT DOCUMENTS

CA 2908848 C 5/2021
CA 3187410 A1 * 8/2022 ..... B01D 19/0052
(Continued)

OTHER PUBLICATIONS

Cliff, "Spring Types and Materials in Sealing Systems". Nov. 8, 2019, Eclipse Engineering, eclipseseal.com/blog/technology/spring-types-materials-sealing-systems/. Accessed Jun. 10, 2023. (Year: 2019).*

(Continued)

*Primary Examiner* — David E Sosnowski
*Assistant Examiner* — Jackson N Gillenwaters
(74) *Attorney, Agent, or Firm* — Conley Rose, P.C.; Rodney B. Carroll

(57) ABSTRACT

An electric submersible pump (ESP) electric motor. The ESP electric motor comprises a drive shaft; a first metal compliance ring located around the drive shaft; a second metal compliance ring located around the drive shaft; a first bearing sleeve located around the drive shaft, located around the first metal compliance ring, and located around the second metal compliance ring, wherein there is an interference fit between the inside of the first bearing sleeve and the first metal compliance ring and between the inside of the first bearing sleeve and the second metal compliance ring; and a second bearing sleeve located around the first bearing sleeve and located inside an inner bore of a stator of the electric motor.

20 Claims, 6 Drawing Sheets

(56) References Cited

U.S. PATENT DOCUMENTS

| | | | | |
|---|---|---|---|---|
| 10,435,961 | B2 * | 10/2019 | Estrada | E21B 7/062 |
| 10,968,918 | B2 * | 4/2021 | Watson | F04D 13/10 |
| 2002/0125777 | A1 | 9/2002 | Parmeter et al. | |
| 2012/0257985 | A1 | 10/2012 | Parmeter et al. | |
| 2020/0232473 | A1 | 7/2020 | Davis | |
| 2022/0090603 | A1 | 3/2022 | Forsberg | |

FOREIGN PATENT DOCUMENTS

| | | | |
|---|---|---|---|
| EA | 031287 | B1 | 12/2018 |
| WO | 2017160388 | A1 | 9/2017 |

OTHER PUBLICATIONS

Foreign Communication from Related Application—International Search Report and Written Opinion of the International Searching Authority, International Application No. PCT/US2023/014227, dated Jun. 20, 2023, 10 pages.

* cited by examiner

METAL COMPLIANCE RING-MOUNTED BEARINGS IN ELECTRIC SUBMERSIBLE PUMP MOTOR

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbons, such as oil and gas, are produced or obtained from subterranean reservoir formations that may be located onshore or offshore. The development of subterranean operations and the processes involved in removing hydrocarbons from a subterranean formation typically involve a number of different steps such as drilling a wellbore at a desired well site, treating the wellbore to optimize production of hydrocarbons, performing the necessary steps to produce the hydrocarbons from the subterranean formation, and pumping the hydrocarbons to the surface of the earth. When performing subterranean operations, pump systems, for example, electric submersible pump (ESP) systems, may be used when reservoir pressure alone is insufficient to produce hydrocarbons from a well or is insufficient to produce the hydrocarbons at a desirable rate from the well.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
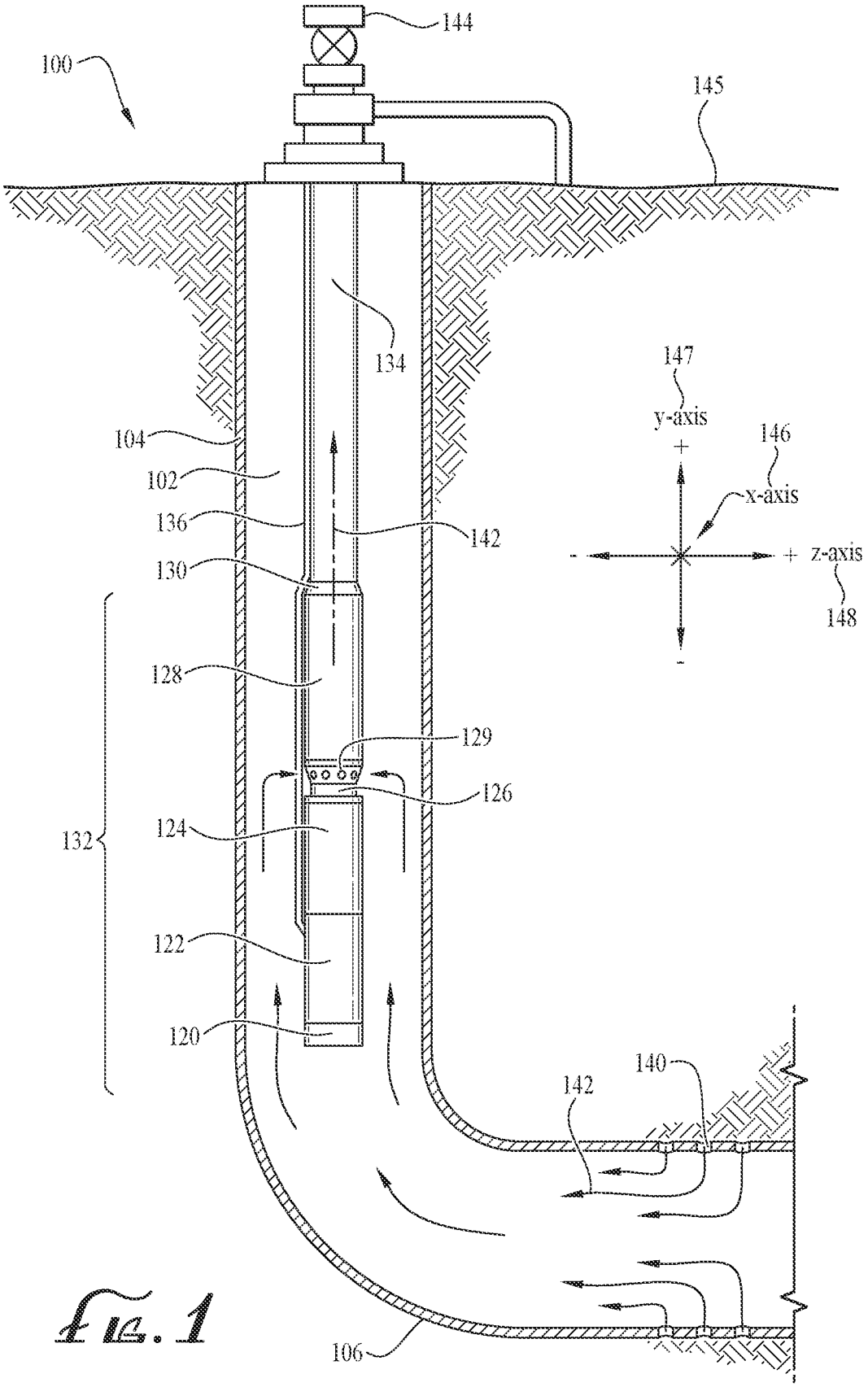
FIG. 1 is an illustration of an electric submersible pump (ESP) assembly in a wellbore according to an embodiment.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," and "down" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" is directed counter to the direction of flow of well fluid, towards the source of well fluid. "Up" is directed in the direction of flow of well fluid, away from the source of well fluid.

Energy companies are asking for electric submersible pump (ESP) assemblies to be capable of operating in higher temperature downhole environments, for example downhole environments having temperatures in the range from 280 degrees Celsius to 450 degrees Celsius. These high temperatures may be encountered, for example, when using steam assisted gravity drainage (SAGD) production techniques. These high temperatures may be encountered, for example, in geothermal production environments. This high temperature operating environment poses a number of design challenges for the ESP assembly components.

The present disclosure teaches using a ceramic inner bearing sleeve in combination with a ceramic outer bearing sleeve in an electric motor of an ESP assembly for operation in a high temperature downhole environment. Ceramic is more tolerant of high temperatures and provides good bearing performance. But the ceramic bearings also introduce some new challenges of their own. Ceramic bearings can be easily damaged by impacts with other objects, for example an impact between an inner ceramic bearing sleeve and an outer ceramic bearing sleeve. Ceramic bearings exhibit a different heat expansion profile (e.g., have a different coefficient of thermal expansion) from other metal components of the electric motor, for example the metal of the drive shaft and the metal of the inner bore of the stator. Additionally, ceramic bearings operate with very fine tolerances which challenge manufacturing capabilities.

The present disclosure teaches using metal compliance rings disposed between an inside surface of a ceramic inner bearing sleeve and an outside surface of the drive shaft to maintain the position of the ceramic inner bearing sleeve aligned with the drive shaft and aligned with the inside surface of the ceramic outer bearing sleeve. The metal compliance rings exhibit a controlled amount of flexibility to adjust to both manufacturing tolerances and to adjust for the different heat expansion profiles of the steel of the drive shaft and the ceramic material of the ceramic inner bearing sleeve (e.g., steel expands more than ceramic expands when heated equally—steel has a higher coefficient of thermal expansion than ceramic has). Thus, as the drive shaft expands proportionally more than the ceramic inner bearing sleeve expands in response to operation in a high temperature environment (e.g., in response to operation in a 280 degree Celsius to a 450 degree Celsius environment), as a result of the different coefficients of thermal expansion of the metal drive shaft and of the ceramic inner bearing sleeve, the metal compliance rings compress slightly but continue to serve their function of maintaining the position of the ceramic inner bearing sleeve aligned with the drive shaft and aligned with the inside surface of the ceramic outer bearing sleeve (e.g., with the outer surface of the ceramic inner bearing sleeve parallel to the inner surface of the ceramic outer bearing sleeve). Likewise, if there is some variation from a nominative dimension of one or more of the metal compliance rings, as the result of manufacturing tolerances, the metal compliance rings can adapt by compressing slightly more or slightly less but continue to serve their function of maintaining the position of the ceramic inner bearing sleeve aligned with the drive shaft and aligned with the inside surface of the ceramic outer bearing sleeve (e.g., with the outer surface of the ceramic inner bearing sleeve parallel to the inner surface of the ceramic outer bearing sleeve).

The metal compliance rings exhibit a controlled amount of flexibility to maintain radial location of bearing sleeves, for example in response to transient radially directed forces and/or disturbances on the drive shaft during operation of the electric motor of an ESP assembly. One of the sets of metal compliance rings exhibit a controlled amount of flexibility to allow for a controlled amount of bearing tilt, whereby to maintain the mating surfaces of the ceramic inner bearing sleeve and the ceramic outer bearing sleeve (e.g., the outside surface of the ceramic inner bearing sleeve and the inside surface of the ceramic outer bearing sleeve) substantially parallel with each other, for example when the ceramic outer bearing sleeve tilts in response to a transient torque and/or a disturbance.

The idea of compliance rings used herein refers to a flexible ring structure that exhibits elastic properties within an acceptable, designed range of flexure or within an acceptable, designed range of expansion and compression. Thus, the compliance ring may flex in a first direction (e.g., compress) in response to a first transient force and then restore its shape to its steady state condition after the first transient force subsides (e.g., expand) and then flex in a second different direction (e.g., expand) in response to a second transient force and then restore its shape to its steady state condition as the second transient force subsides (e.g., compress). Once installed over the drive shaft, the expansion and compression is typically radial expansion or compression. In an embodiment, the compliance rings are installed with an interference fit, such that the compliance rings are in a steady state condition of some compression but remain able to flex in response to changes with both further compression and expansion relative to their steady state condition. Under steady state operating condition, the compliance rings create a balance of radially directed forces between the outer surface of the drive shaft and the inner surface of the ceramic inner bearing sleeve. The compliance property of the compliance rings allows the compliance rings to be compressed in response to a transient force, and then restore (e.g., expand) to their steady state condition and to expand in response to a different transient force, and then restore (e.g., compress) to their steady state condition.

In an embodiment, the drive shaft of the electric motor defines circumferential grooves, and the metal compliance rings are slid onto the drive shaft and into the circumferential grooves. The ceramic inner bearing sleeve may then be slid over the drive shaft and over the metal compliance rings. In this position and without any external radial forces applied to the ceramic inner bearing sleeve, the metal compliance rings maintain the ceramic inner bearing sleeve in a neutral position in which a longitudinal axis of the inner bearing sleeve coincides with a longitudinal axis of the drive shaft. In some contexts, the metal compliance rings located between the drive shaft and the inside surface of the ceramic inner bearing sleeve may be said to mount the ceramic inner bearing sleeve or to provide mounting for the ceramic inner bearing sleeve. When external forces are applied to the ceramic inner bearing sleeve, for example applied by the ceramic outer bearing sleeve, the metal compliance rings mounted on the drive shaft permit the ceramic inner bearing sleeve to move within narrow limits to relieve the stress otherwise caused by the external forces. For example, the metal compliance rings may deform and/or flex slightly to allow the ceramic inner bearing sleeve to move radially so its longitudinal axis is offset from the longitudinal axis of the drive shaft. For example, for example the metal compliance rings may deform and/or flex slightly to allow the ceramic inner bearing sleeve to tilt with reference to the drive shaft so the longitudinal axis of the ceramic inner bearing sleeve is not parallel to the longitudinal axis of the drive shaft.

Metal compliance rings can also be disposed between an outside surface of the ceramic outer bearing sleeve and an inside surface of the bore of the stator. In this position and without external forces applied to the ceramic outer bearing sleeve, the metal compliance rings between the outside surface of the ceramic outer bearing sleeve and the inside surface of the bore of the stator maintain the ceramic outer bearing sleeve in a neutral position in which a longitudinal axis of the ceramic outer bearing sleeve coincides with a longitudinal axis of the bore of the stator. In some contexts, the metal compliance rings between the outside surface of the ceramic outer bearing and the inside surface of the bore of the stator may be said to mount the ceramic outer bearing sleeve or to provide mounting to the ceramic outer bearing sleeve. The metal compliance rings between the outer surface of the ceramic outer bearing sleeve and the inside surface of the stator bore exhibit a controlled amount of flexibility to adjust to both manufacturing tolerances and to adjust for the different heat expansion profiles of the steel of the stator and the ceramic material of the ceramic outer bearing sleeve. It is noted that the metal compliance rings between the drive shaft and the inside surface of the ceramic inner bearing sleeve and the metal compliance rings between the outside surface of the ceramic outer bearing sleeve and the inner surface of the stator bore cooperate to locate the drive shaft and to maintain the longitudinal axis of the drive shaft substantially coincident with a longitudinal axis of the stator. In an embodiment, the inner bearing sleeve and the outer bearing sleeve are both made of metal instead of ceramic, for example when the ESP electric motor is designed for use in a moderate temperature environment. The two sets of metal compliance rings may still provide advantages when used to mount a metal inner bearing sleeve and a metal outer bearing sleeve.

In an embodiment, the metal compliance rings are garter springs (e.g., helical springs, formed into a circle, with opposite ends of the helical spring connected together). Springs can be manufactured to provide predictable stiffness that provide the controlled amount of compliance that is desired to mount the inner and outer bearing sleeves in the electric motor of an ESP assembly. In an embodiment, the metal compliance rings are helical metal springs each formed by winding a metal tape in a helical shape, turning the ends of the helically wound tape around to face each other, thereby forming a circle, and welding opposite ends of the metal tape to each other. By adjusting the thickness of the metal tape, the width of the metal tape, the space between the helical loops, and the diameter of the helix, the compliance properties of the helical metal spring can be manufactured to provide the desired flexibility for the given bearing design.

While the use of the metal compliance rings has advantages in higher temperature environments, they also provide advantages in other more general temperature environments. For example, the metal compliance rings have advantages for stabilizing the inner bearing sleeve when used in a permanent magnet motor (PMM). PMMs have very high radial loads generated by the strong permanent magnets. The metal compliance rings are suitable for bearing the high radial loads associated with strong permanent magnets. In moderate temperature environments, metal bearing sleeves may be used in combination with the metal compliance rings rather than the more demanding ceramic bearings.

Turning now to FIG. 1, a wellsite 100 is described. The wellsite 100 comprises a wellbore 102 optionally lined with a casing 104, an electric submersible pump (ESP) assembly 132 in the wellbore 102, and a production tubing string 134. The ESP assembly 132 comprises an optional sensor unit 120 at a downhole end, an electric motor 122 coupled to the sensor unit 120 uphole of the sensor unit 120, a seal section 124 coupled to the electric motor 122 uphole of the electric motor 122, a fluid intake 126 coupled to the seal section 124 uphole of the seal section 124, a production pump assembly 128 coupled to the fluid intake 126 uphole of the fluid intake 126, and a pump discharge 130 coupled to the production pump assembly 128 uphole of the production pump assembly 128. The electric motor 122 comprises metal compliance rings that stabilize inner and outer bearing sleeves inside the electric motor 122. The metal compliance rings, the inner bearing sleeves, and the outer bearing sleeves are described further hereinafter. The pump discharge 130 is coupled to the production tubing string 134. In an embodiment, a motor head or pot head (not shown) is coupled between the electric motor 122 and the seal section 124.

In an embodiment, the production pump assembly 128 may have an outside diameter from 3.0 inches to 10 inches. In an embodiment, the production pump assembly 128 may have an outside diameter from 3.25 inches to 7.5 inches. In an embodiment, the production pump assembly 128 may have an outside diameter from 3.5 inches to 5.5 inches. In an embodiment, the production pump assembly 128 may be have a different outside diameter from any of the examples given above. In an embodiment, the electric motor 122 may have an outside diameter from 3.0 inches to 10 inches. In an embodiment, the electric motor 122 may have an outside diameter from 3.5 inches to 8 inches. In an embodiment, the electric motor 122 may have an outside diameter from 3.5 inches to 5.75 inches. In an embodiment, the electric motor 122 may have an outside diameter of about 3.75 inches. In an embodiment, the electric motor 122 may have an outside diameter of about 4.56 inches. In an embodiment, the electric motor 122 may have an outside diameter of about 5.62 inches. In an embodiment, the electric motor 122 may have a different outside diameter from any of the examples given above. In an embodiment, the seal section 124 may have an outside diameter from 3.0 inches to 10 inches. In an embodiment, the seal section 124 may have an outside diameter from 3.5 inches to 8 inches. In an embodiment, the seal section 124 may have an outside diameter from 3.5 inches to 5.75 inches. In an embodiment, the seal section 124 may have an outside diameter of about 3.75 inches. In an embodiment, the seal section 124 may have an outside diameter of about 4.56 inches. In an embodiment, the seal section 124 may have an outside diameter of about 5.62 inches. In an embodiment, the seal section 124 may have a different outside diameter from any of the examples given above.

In an embodiment, the casing 104 has perforations 140 that allow reservoir fluid 142 to enter the wellbore 102 and flow downstream to the fluid intake 126. The reservoir fluid 142 enters inlet ports 129 of the fluid intake 126, flows from the fluid intake 126 into an inlet of the production pump assembly 128, is pumped by the production pump assembly 128 to flow out of the production pump assembly 128 into the pump discharge 130 up the production tubing string 134 to a wellhead 144 located at the surface 134. In some contexts, the reservoir fluid 142 may be referred to as production fluid. In an embodiment, the reservoir fluid may be crude oil, natural gas, liquid phase hydrocarbon, gas phase hydrocarbon, or mixed phase hydrocarbon fluid. In an embodiment directed to a geothermal well, the reservoir fluid may be a hot liquid, such as hot water or hot salt water.

In an embodiment, an electric cable 136 is connected to the electric motor 122 and provides electric power from an electric power source located at the surface 145 to the electric motor 122 to cause the electric motor 122 to turn and deliver rotational power to the production pump assembly 128. In an embodiment, the electric cable 136 attaches to the electric motor 122 via a motor head or pot head. In an embodiment, the production pump assembly 128 comprises one or more centrifugal pump stages, where each centrifugal pump stage comprises an impeller coupled to a drive shaft of the production pump assembly 128 and a diffuser retained by a housing of the production pump assembly 128. The drive shaft of the production pump assembly is coupled to a drive shaft of the seal section 124. The drive shaft of the seal section 124 is coupled to a drive shaft of the electric motor 122. In some contexts, the production pump assembly 128 may be referred to as a centrifugal pump assembly. The production pump assembly 128 may be said to lift the reservoir fluid 138 to the surface 145.

In an embodiment, the ESP assembly 132 may further comprise a gas separator assembly, for example located between the fluid intake 126 and the production pump assembly 128. The gas separator assembly may induce rotational motion of the reservoir fluid 142 within a separation chamber such that high gas liquid ratio fluid concentrates near a drive shaft of the gas separator assembly and a low gas liquid ratio fluid concentrates near an inside housing of the gas separator assembly. The high gas liquid ratio fluid exits the gas separator by gas discharge ports of a cross-over to an exterior of the gas separator (e.g., into the wellbore 102 outside the ESP assembly 132), and the low gas liquid ratio fluid is flowed by liquid discharge ports of the cross-over to the inlet of the production pump assembly 128. In this way, the gas separator assembly may provide a lower gas liquid ratio fluid to the production pump assembly 128 when the reservoir fluid 142 comprises a mix of gas phase and liquid phase fluid. The drive shaft of the gas separator assembly may be coupled to the drive shaft of the seal section 124 at a downhole end and coupled at an uphole end to the downhole end of the drive shaft of the production pump assembly 128.

In a geothermal operation, the reservoir fluid 142 may be pumped from the production pump assembly 128 through the production tubing 134 to the surface 145 to pass through a heat exchanger and heat a circulating fluid passing through the heat exchanger. The circulating fluid may then flow back to radiators to heat building interiors or to perform industrial process heating. Alternatively, the reservoir fluid 142 may be directed into an organic Rankine cycle machine located at the surface, for example transferring heat from the reservoir fluid 142 to an organic working fluid having a low temperature liquid-vapor phase change, where the working fluid is then expanded through a turbine or other expander of the organic Rankine cycle machine to convert thermal energy to mechanical power.

An orientation of the wellbore 102 and the ESP assembly 132 is illustrated in FIG. 1 by an x-axis 146, a y-axis 147, and a z-axis 148. While the wellbore 102 is illustrated in FIG. 1 as having a deviated portion or a substantially horizontal portion 106, the ESP assembly 132 may be used in a substantially vertical wellbore 102. While the wellsite 100 is illustrated as being on-shore, the ESP assembly 132 may be used in an offshore location as well.

Figure 2:
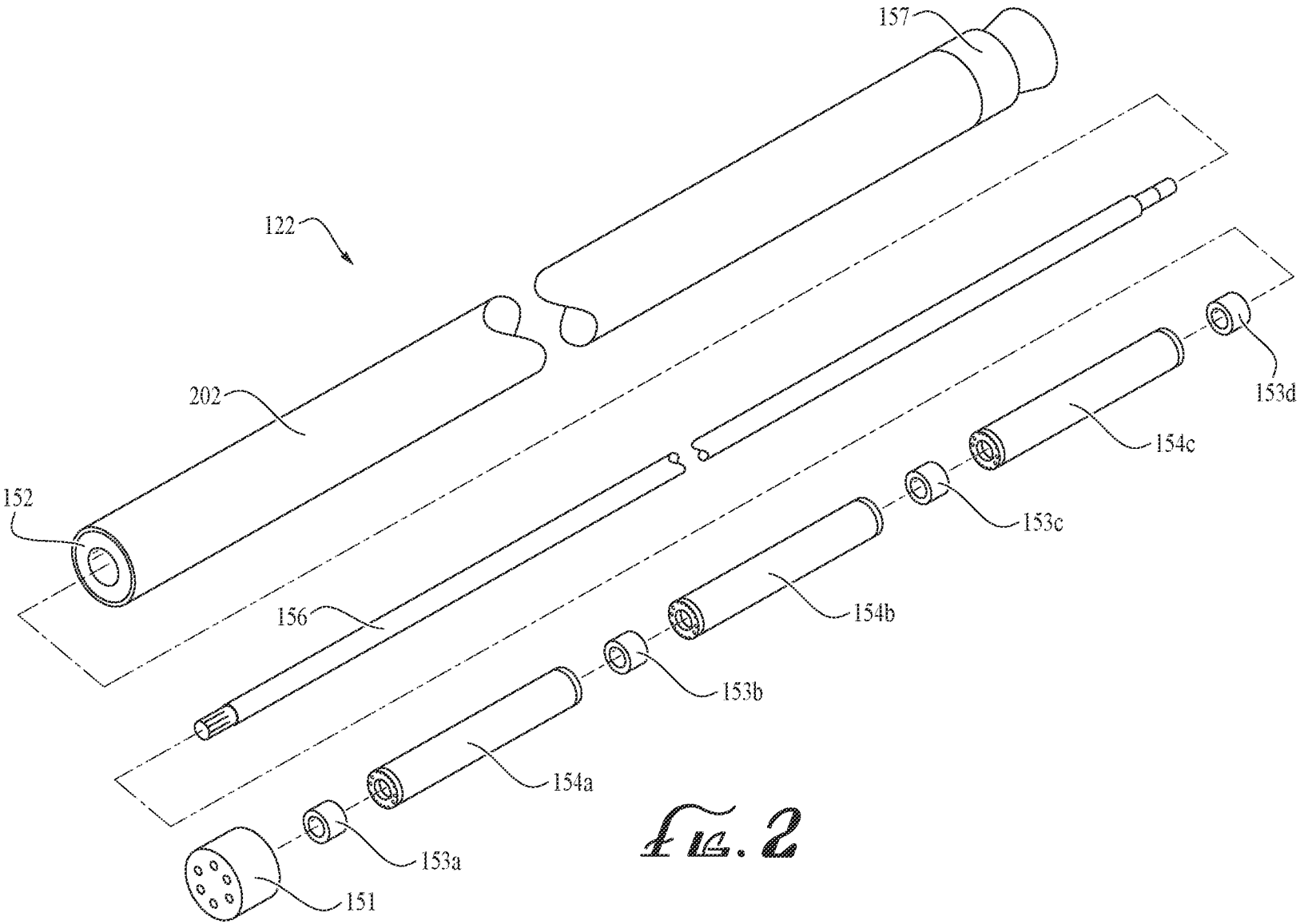
FIG. 2 is an illustration of an ESP electric motor according to an embodiment of the disclosure.

Turning now to FIG. 2, some of the components of the electric motor 122 are shown. In an embodiment, the electric motor 122 comprises a drive shaft 156 that is mechanically coupled to a rotor 154, and this assembly is inserted into a stator 152. The stator 152 is retained within a housing 202. In an embodiment, a plurality of rotors 154—for example a first rotor 154*a*, a second rotor 154*b*, and a third rotor 154*c*— are coupled to the drive shaft 156. While FIG. 2 illustrates three rotors, in another embodiment, the electric motor 122 comprises a single rotor 154, two rotors 154, four rotors, five rotors, or more rotors. In some contexts, the rotors 154*a*, 154*b*, 154*c* may be referred to as rotor modules and the complete assembly of multiple rotor modules may be referred to as a rotor 154.

In an embodiment, the drive shaft 156 may be about 0.4 inches in outside diameter. In an embodiment, the drive shaft 156 may be about 0.5 inches in outside diameter. In an embodiment, the drive shaft 156 may be about 0.625 inches in outside diameter. In an embodiment, the drive shaft 156 may be about 0.75 inches in outside diameter. In an embodiment, the drive shaft 156 may be about 0.875 inches in outside diameter. In an embodiment, the drive shaft 156 may be about 1.0 inches in outside diameter. In an embodiment, the drive shaft 156 may be about 1.25 inches in outside diameter. In an embodiment, the drive shaft 156 may be about 1.5 inches in outside diameter. In an embodiment, the drive shaft 156 may be about 1.75 inches in outside diameter. In an embodiment, the drive shaft 156 may be about 2.0 inches in outside diameter. In an embodiment, the drive shaft 156 has an outside diameter between 0.4 inches and 2.0 inches. In an embodiment, the drive shaft 156 has an outside diameter between 0.5 inches and 1.5 inches. In an embodiment, the drive shaft 156 has an outside diameter between 0.625 inches and 1.25 inches.

In an embodiment, the electric motor 122 may comprise a plurality of drive shafts 156 that are mated to transfer torque collectively. For example, the first rotor 154*a* may be coupled to a first drive shaft; the second rotor 154*b* may be coupled to a second drive shaft; and the third rotor 154*c* may be coupled to a third drive shaft. The first drive shaft may be coupled to the second drive shaft, and the second drive shaft may be coupled to the third drive shaft.

In an embodiment (e.g., a conventional induction electric motor), each rotor 154 comprises a core and an induction squirrel cage that comprises conductors parallel to the center axis of the drive shaft 156, a first end ring electrically connected to a first set of ends of the conductors, and a second end ring electrically connected to a second set of ends of the conductors. In another embodiment (e.g., a PMM electric motor), each rotor 154 comprises a core and permanent magnet elements. The core may be formed from a plurality of metal laminations defining apertures to receive the conductors or the permanent magnet elements. The laminations may be made of magnetic metal. The laminations may be coated with an insulating material to reduce eddy currents between laminations of the rotor core. In an embodiment, the rotor core may be a solid core of magnetic metal. In an embodiment (e.g., in a hybrid PMM electric motor), each rotor 154 may be a hybrid rotor and may comprise a core, an induction squirrel cage, and permanent magnet elements.

While not illustrated as such in FIG. 2, the stator 152 may comprise a plurality of stator modules, and the complete assembly of multiple stator modules may be referred to as the stator 152. The number of stator modules may correspond to the number of rotor modules. Each stator module may comprise stator windings retained by a stator core formed of laminations. Each lamination of the stator core may be a flat sheet of magnetic metal that defines apertures to receive the stator windings. The laminations of the stator core are maintained in rotational alignment such that corresponding apertures of the laminations line up with each other. The laminations may be coated with an insulating material to reduce eddy currents between the laminations of the stator core. In an embodiment, the stator core may be a solid core of magnetic metal.

In an embodiment, the plurality of rotors 154 are sandwiched between bearings 153—for example first bearing 153*a*, second bearing 153*b*, third bearing 153*c*, and fourth bearing 153*d*. The bearings 153 may be supported by the inside of the stator 152. The bearings 153 support and stabilize the drive shaft 156 and maintain an air gap between an outside of the rotor 154 and the inside of the stator 152. The bearings 153 each comprise an inner bearing sleeve and an outer bearing sleeve. The bearings 153 are mounted by one or more sets of metal compliance rings. The bearings 153 and the metal compliance rings are described further hereinafter.

An uphole end of the electrical motor 122 may comprise a head 157, and a downhole end of the electric motor 122 may comprise a base 151. The head 157 may provide features for coupling the electric motor 122 to the seal section 114, and the base 151 may provide features for coupling the sensor package 118 or a second electric motor to the electric motor 122.

Figure 3:
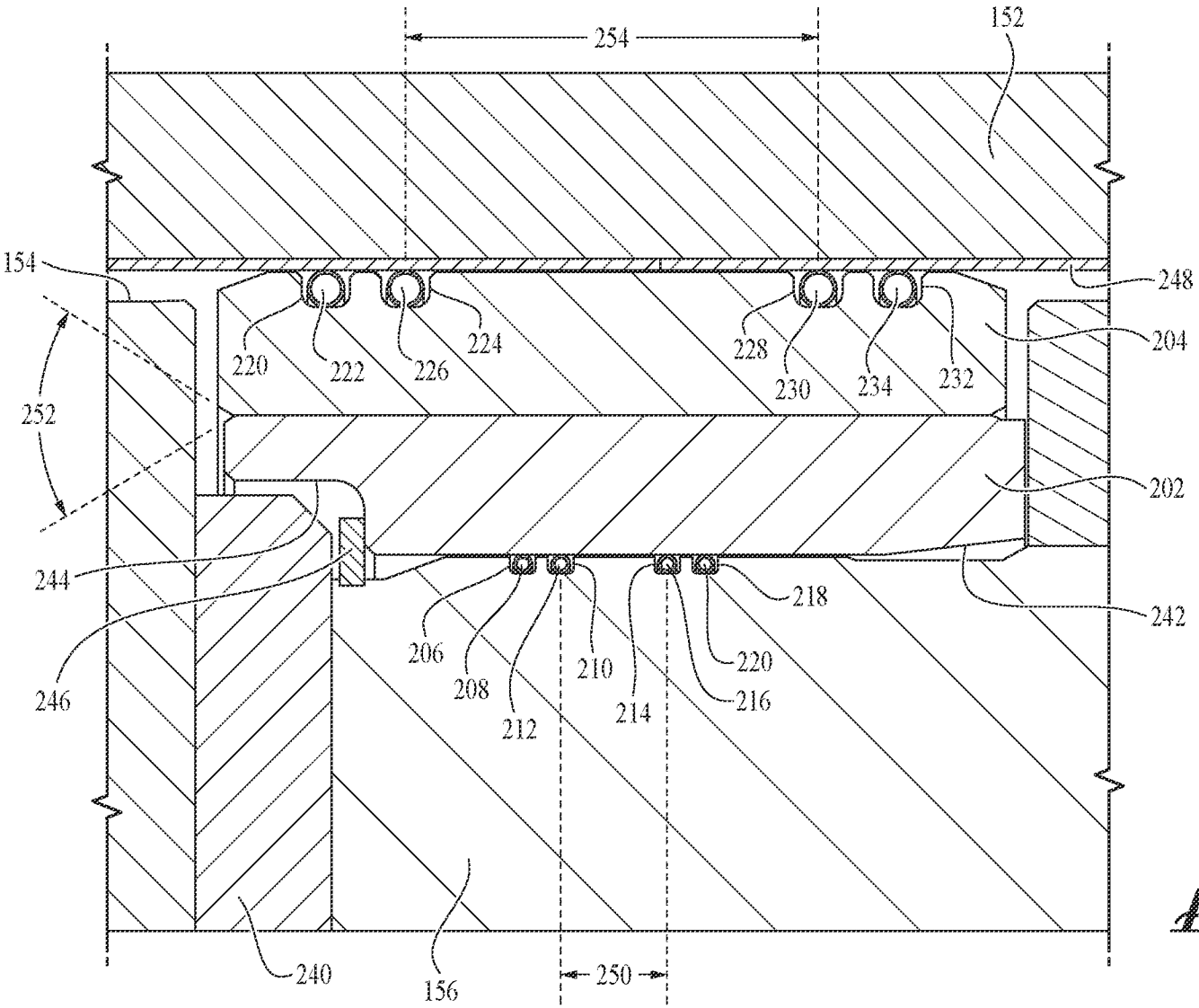
FIG. 3 is an illustration of a bearing and bearing mounting mechanisms according to an embodiment of the disclosure.

Turning now to FIG. 3, a set of sleeve bearings mounted using metal compliance rings is described. The bearing set comprises an inner bearing sleeve 202 and an outer bearing sleeve 204. In an embodiment, the bearing set comprising inner bearing sleeve 202 and outer bearing sleeve 204 may be substantially similar to the bearings 153*a*, 153*b*, 153*c*, 153*d* illustrated in FIG. 2. In an embodiment, the inner bearing sleeve 202 and the outer bearing sleeve 204 are each made of ceramic. Ceramic bearings provide good service in high temperature downhole environments, for example in temperature ranges of 280 degrees Celsius to 350 degrees Celsius, in temperature ranges of 280 degrees Celsius to 400 degrees Celsius, in temperature ranges of 280 degrees Celsius to 450 degrees Celsius, in temperature ranges of 280 degrees Celsius to 500 degrees Celsius, or in temperature ranges of 280 degrees Celsius to 550 degrees Celsius. It is understood that ceramic bearings are not limited to operation at temperatures above 280 degrees Celsius: they may give good service at lower temperatures too, for example at temperatures below 260 degrees Celsius, below 200 degrees Celsius, below 150 degrees Celsius, below 100 degrees Celsius, below 50 degrees Celsius, etc., but in such lower temperature ranges metal bearings may be equally serviceable relative to ceramic bearings. In another embodiment, the inner bearing sleeve 202 and the outer bearing sleeve 204 are each made of metal, for example when the electric motor 122 and the ESP assembly 132 are intended to be operated in a moderate temperature downhole environment.

In an embodiment, a first plurality of metal compliance rings is used to mount the inner bearing sleeve 202 onto the drive shaft 156. The first plurality of metal compliance rings provides anti-rotational stabilization for the inner bearing sleeve 202. The first plurality of metal compliance rings contributes to maintaining a longitudinal axis of the inner bearing sleeve 202 concentric with a longitudinal axis of the drive shaft 154 and with a longitudinal axis of the outer bearing sleeve 204. In an embodiment, the first plurality of metal compliance rings also provides tilt stabilization to the inner bearing sleeve 202 (e.g., maintaining the outer surface of the inner bearing sleeve 202 substantially axially parallel to the inner surface of the outer bearing sleeve 204). In an embodiment, the anti-rotation stabilization provided by the first plurality of compliance rings may be complemented by the use of one or more keys fitted between one or more longitudinal grooves (e.g., keyways) defined in the outside surface of the drive shaft 156 and a corresponding aligned one or more longitudinal grooves (e.g., keyways) defined in the inside surface of the inner bearing sleeve 202.

In an embodiment, in a steady state (e.g., during operation without a transient radially directed force or disturbance acting upon the inner bearing sleeve 202 and without a transient torque acting upon the inner bearing sleeve 202), the first plurality of metal compliance rings may maintain a space between the outside surface of the drive shaft 156 and the inside surface of the inner bearing sleeve 202 of about 150 microns. In an embodiment, in a steady state, the first plurality of metal compliance rings may maintain a space between the outside surface of the drive shaft 156 and the inside surface of the inner bearing sleeve 202 of about 75 microns. In an embodiment, in a steady state, the first plurality of metal compliance rings may maintain a space between the outside surface of the drive shaft 156 and the inside surface of the inner bearing sleeve 202 of between 40 microns and 250 microns. In an embodiment, in a steady state, the first plurality of metal compliance rings may maintain a space between the outside surface of the drive shaft 156 and the inside surface of the inner bearing sleeve 202 of between 60 microns and 200 microns. In an embodiment, in a steady state, the first plurality of metal compliance rings may maintain a space between the outside surface of the drive shaft 156 and the inside surface of the inner bearing sleeve 202 of between 70 microns and 180 microns. In an embodiment, in a steady state, the first plurality of metal compliance rings may maintain a space between the outside surface of the drive shaft 156 and the inside surface of the inner bearing sleeve 202 of between 40 microns and 100 microns. In an embodiment, in a steady state, the first plurality of metal compliance rings may maintain a space between the outside surface of the drive shaft 156 and the inside surface of the inner bearing sleeve 202 of between 55 microns and 90 microns. In an embodiment, in a steady state, the first plurality of metal compliance rings may maintain a space between the outside surface of the drive shaft 156 and the inside surface of the inner bearing sleeve 202 of between 70 microns and 80 microns. In an embodiment, in a steady state, the first plurality of metal compliance rings may maintain a space between the outside surface of the drive shaft 156 and the inside surface of the inner bearing sleeve 202 of between 110 microns and 190 microns. In an embodiment, in a steady state, the first plurality of metal compliance rings may maintain a space between the outside surface of the drive shaft 156 and the inside surface of the inner bearing sleeve 202 of between 135 microns and 165 microns. In an embodiment, in a steady state, the first plurality of metal compliance rings may maintain a space between the outside surface of the drive shaft 156 and the inside surface of the inner bearing sleeve 202 of between 145 microns and 155 microns.

In an embodiment, the first plurality of metal compliance rings comprises a first metal compliance ring 208, a second metal compliance ring 212, a third metal compliance ring 216, and a fourth metal compliance ring 220. In an embodiment, an outside surface of the drive shaft 156 defines a first circumferential groove 206 that receives the first metal compliance ring 208, a second circumferential groove 210 that receives the second metal compliance ring 212, a third circumferential groove 214 that receives the third metal compliance ring 216, and a fourth circumferential groove 218 that receives the fourth metal compliance ring 220. The grooves 206, 210, 214, 218 (and hence the metal compliance rings 208, 212, 216, 220) may be located such that a midpoint between the grooves 206, 210, 214, 218 is aligned with a middle point of the hydrodynamic film interface between the outside surface of the inner bearing sleeve 202 and the inside surface of the outer bearing sleeve 204. Said in other words, the grooves 206, 210, 214, 218 (and hence the metal compliance rings 208, 212, 216, 220) are positioned symmetrically to the middle point of the hydrodynamic film located between the inner bearing sleeve 202 and the outer bearing sleeve 204 when the electric motor 122 is operating. As used herein, 'outside surface' of a bearing sleeve is the annular side wall furthest away from a longitudinal axis of the bearing sleeve, and 'inside surface' of a bearing sleeve is the annular side wall closest to the longitudinal axis of the bearing sleeve.

The grooves 206, 210, 214, 218 may be sized to permit the corresponding metal compliance rings 208, 212, 216, 220 to be expanded into the grooves when the metal compliance rings 208, 212, 216, 220 flex under compression. In an embodiment, the grooves that retain the first set of metal compliance rings may be defined by an inside surface of the inner bearing sleeve 202 rather than in the outside surface of the drive shaft 156. While FIG. 3 illustrates the first plurality of metal compliance rings comprising four metal compliance rings, in another embodiment, the first plurality of metal compliance rings may comprise two metal compliance rings, six metal compliance rings, eight metal compliance rings, ten metal compliance rings, or some greater even number of metal compliance rings. Alternatively, the first plurality of metal compliance rings may comprise three metal compliance rings, five metal compliance rings, seven metal compliance rings, nine metal compliance rings, or some greater odd number of metal compliance rings. The number of metal compliance rings used may be selected based on a desired combined stiffness and force exerted by the combination of the first plurality of metal compliance rings. In an embodiment, the metal compliance rings 208, 212, 216, 220 have an interference fit with the circumferential grooves 206, 210, 214, 218 and with the inside surface of the inner bearing sleeve 202. As such, the metal compliance rings 208, 212, 216, 220 in a neutral or steady-state position may be in tension and/or in radial compression and exerting radial force outwards from the longitudinal center of the drive shaft 154 onto the inside surface of the inner bearing sleeve 202.

In an embodiment, a second plurality of metal compliance rings is used to mount the outer bearing sleeve 204 into an inner bore of the stator 152. The second plurality of metal compliance rings provides anti-rotational stabilization for the outer bearing sleeve 204. In an embodiment, the second plurality of metal compliance rings contributes to maintaining the longitudinal axis of the outer bearing sleeve 204 concentric with the longitudinal axis of the stator 152 and with the longitudinal axis of the inner bearing sleeve 202. In an embodiment, the second plurality of metal compliance rings comprises a fifth metal compliance ring 222, a sixth metal compliance ring 226, a seventh metal compliance ring 230, and an eighth metal compliance ring 234. In an embodiment, the inner bore 248 of the stator 152 defines a fifth circumferential groove 220 that receives the fifth metal compliance ring 222, a sixth circumferential groove 224 that receives the sixth metal compliance ring 226, a seventh circumferential groove 228 that receives the seventh metal compliance ring 230, and an eighth circumferential groove 232 that receives the eighth metal compliance ring 234.

In an embodiment, in a steady state (e.g., during operation without a transient radially directed force or disturbance acting upon the outer bearing sleeve 204 and without a transient torque acting upon the outer bearing sleeve 204), the second plurality of metal compliance rings may maintain a space between the inner bore 248 of the stator 152 and the outside surface of the outer bearing sleeve 204 of about 150 microns. In an embodiment, in a steady state, the second plurality of metal compliance rings may maintain a space between the inner bore 248 of the stator 152 and the outside surface of the outer bearing sleeve 204 of about 75 microns. In an embodiment, in a steady state, the second plurality of metal compliance rings may maintain a space between the inner bore 248 of the stator 152 and the outside surface of the outer bearing sleeve 204 of between 40 microns and 250 microns. In an embodiment, in a steady state, the second plurality of metal compliance rings may maintain a space between the inner bore 248 of the stator 152 and the outside surface of the outer bearing sleeve 204 of between 60 microns and 200 microns. In an embodiment, in a steady state, the second plurality of metal compliance rings may maintain a space between the inner bore 248 of the stator 152 and the outside surface of the outer bearing sleeve 204 of between 70 microns and 180 microns. In an embodiment, in a steady state, the second plurality of metal compliance rings may maintain a space between the inner bore 248 of the stator 152 and the outside surface of the outer bearing sleeve 204 of between 40 microns and 100 microns. In an embodiment, in a steady state, the second plurality of metal compliance rings may maintain a space between the inner bore 248 of the stator 152 and the outside surface of the outer bearing sleeve 204 of between 55 microns and 90 microns. In an embodiment, in a steady state, the second plurality of metal compliance rings may maintain a space between the inner bore 248 of the stator 152 and the outside surface of the outer bearing sleeve 204 of between 70 microns and 80 microns. In an embodiment, in a steady state, the second plurality of metal compliance rings may maintain a space between the inner bore 248 of the stator 152 and the outside surface of the outer bearing sleeve 204 of between 110 microns and 190 microns. In an embodiment, in a steady state, the second plurality of metal compliance rings may maintain a space between the inner bore 248 of the stator 152 and the outside surface of the outer bearing sleeve 204 of between 135 microns and 165 microns. In an embodiment, in a steady state, the second plurality of metal compliance rings may maintain a space between the inner bore 248 of the stator 152 and the outside surface of the outer bearing sleeve 204 of between 145 microns and 155 microns.

In an embodiment, the anti-rotation stabilization provided by the second plurality of metal compliance rings may be complemented by use of a key that fits in a longitudinal groove (e.g., a keyway) in the outside surface of the outer bearing sleeve 204 and a longitudinal groove (e.g., a keyway) in the inside surface of the inner bore 248 of the stator 152. The key may define slots that align with the locations of the second plurality of metal compliance rings. In an embodiment, the second plurality of metal compliance rings may first be slid over the outside surface of the outer bearing sleeve 204; second the key may be installed into the longitudinal groove in the outside surface of the outer bearing sleeve 204, aligning the slots of the key with the locations of the second plurality of metal compliance rings; and third the stator 152 may be slid over the outer bearing sleeve 204 and the key, with the longitudinal groove in the inner bore 248 of the stator 152 mated with the key (or the assembly of the drive shaft 156, the rotor 154, the second set of metal compliance rings, and the key may be slid into the stator 152 with the key mated to the longitudinal groove in the inner bore 248 of the stator 152). In an embodiment, the longitudinal grooves in the outer surface of the outer bearing sleeve 204 and in the inner bore 248 of the stator 152 may extend only in the space 254 between the sixth metal compliance ring 226 and the seventh metal compliance ring, and the key may be a short key that extends slightly less than the space 254.

In an embodiment, a plurality of longitudinal grooves may be displaced angularly about the outside surface of the outer bearing sleeve 204 and displaced angularly about the inner bore 248 of the stator 152. For example, two longitudinal grooves may be located 180 degrees apart in the outside surface of the outer bearing sleeve 204, two longitudinal grooves located 180 degrees apart in the inner bore 248 of the stator 152, and two keys may be fitted into the two matching sets of longitudinal grooves. For example, three longitudinal grooves may be located 120 degrees apart in the outside surface of the outer bearing sleeve 204, three longitudinal grooves located 120 degrees apart in the inner bore 248 of the stator 152, and three keys may be fitted into the three matchings sets of longitudinal grooves. Alternatively, other numbers of keys may be disposed in other angularly located sets of longitudinal grooves in the outside surface of the outer bearing sleeve 204 and longitudinal grooves in the inner bore 248 of the stator 152.

The grooves 220, 224, 228, 232 (and hence the metal compliance rings 222, 226, 230, 234) may be located such that a midpoint between the grooves 220, 224, 228, 232 is aligned with a middle point of the hydrodynamic film interface between the outside surface of the inner bearing sleeve 202 and the inside surface of the outer bearing sleeve 204. Said in other words, the grooves 220, 224, 228, 232 (and hence the metal compliance rings 222, 226, 230, 234) are positioned symmetrically to the middle point of the hydrodynamic film located between the inner bearing sleeve 202 and the outer bearing sleeve 204 when the electric motor 122 is operating.

The grooves 220, 224, 228, 232 may be sized to permit the corresponding metal compliance rings 222, 226, 230, 234 to be expanded into the grooves when the metal compliance rings 222, 226, 230, 232 flex under compression. While FIG. 3 illustrates the second plurality of metal compliance rings comprising four metal compliance rings, in another embodiment, the second plurality of metal compliance rings may comprise two metal compliance rings, six metal compliance rings, eight metal compliance rings, ten metal compliance rings, or some greater even number of metal compliance rings. Alternatively, the second plurality of metal compliance rings may comprise three metal compliance rings, five metal compliance rings, seven metal compliance rings, nine metal compliance rings, or some greater odd number of metal compliance rings.

In an embodiment, the metal compliance rings 208, 212, 216, 220 may be slid over the drive shaft 156 into place in the circumferential grooves 206, 210, 214, 218. The metal compliance rings 208, 212, 216, 220 may expand slightly to fit over the drive shaft 156. Said in other words, in a relaxed state, the inside diameter of the metal compliance rings 208, 212, 216, 220 may be slightly less than the outside diameter of the drive shaft 156.

In an embodiment, the first metal compliance ring 208 may be slid over the drive shaft 156 from the left and set in place into the first circumferential groove 206. Next, the second metal compliance ring 212 may be slid over the drive shaft 156 from the left, over the first metal compliance ring 208, and set in place into the second circumferential groove 210. Next, the third metal compliance ring 216 may be slid over the drive shaft 156 from the left, over the first metal compliance ring 208, over the second metal compliance ring 212, and set in place into the third circumferential groove 214. Next, the fourth metal compliance ring 220 may be slid over the drive shaft 156 from the left, over the first metal compliance ring 208, over the second metal compliance ring 212, over the third metal compliance ring 216, and set in place into the fourth circumferential groove 218. In another embodiment, a different sequence and process for installing the metal compliance rings 208, 212, 216, 220 over the drive shaft 156 and setting them into their corresponding circumferential grooves 206, 210, 214, 218 may be performed.

In an embodiment, the manufacturing tolerances of the first set of metal compliance rings 208, 212, 216, 220 may not be as precise as the tolerances of the inner bearing sleeve 202 and the outer bearing sleeve 204, for example when the bearing sleeves 202, 204 are implemented as ceramic bearings. As an example, the tolerances for dimensions of ceramic bearings may be +/−5 microns, the tolerances for the outside diameter of the drive shaft 156 may be +/−12 microns, while the tolerances for the helical diameter 304 (see the discussion of FIG. 4 below) may be +/− about 50 microns. After the metal compliance rings 208, 212, 216, 220 have been slid onto the drive shaft 156 and set into their corresponding circumferential grooves 206, 210, 214, 218, an annular tool having a precisely established inside diameter may be slid over the drive shaft 156 and over the metal compliance rings 208, 212, 216, 220, compressing the metal compliance rings 208, 212, 216, 220 inwards beyond their yield stress. When the annular tool is removed, the metal compliance rings 208, 212, 216, 220 spring back to set the final outside diameter of the metal compliance rings 208, 212, 216, 220 with a fixed plastic deformation. This operation pre-compresses the outer diameter of the metal compliance rings 208, 212, 216, 220 to a pre-determined size that may be more tightly toleranced than possible in the process for manufacturing the metal compliance rings 208, 212, 216, 220. In some embodiments, the passing of the inner bearing sleeve 202 over the metal compliance rings 208, 212, 216, 220 may have much the same pre-compression effect, and the separate step of using the annular tool to pre-compress the metal compliance rings 208, 212, 216, 220 may be avoided. In an embodiment, the second set of metal compliance rings installed between the outer bearing sleeve 202 and the inner bore 248 of the stator, for example metal compliance rings 222, 226, 230, 234 may be compressed inwards using a different annular tool (e.g., a different inside diameter) beyond their yield stress whereby to pre-compress their outer diameter to a pre-determined size that may be more tightly toleranced than possible in the manufacturing process.

In an embodiment, an inside surface of the annular tool(s) may be hardened to reduce wear of the annular tool and allow use of the same tool for a greater number of pre-compression operations before the tool is out of dimension. In an embodiment, the inside surface of the annular tool may be hardened using a heat treatment process. In an embodiment, the inside surface of the annular tool may be hardened using a case-hardening or a carburizing process. In an embodiment, the inside surface of the annular tool may be hardened using a nitriding process.

In an embodiment, the inner bearing sleeve 202 defines a tapered inside profile 242 at one end (e.g., an uphole end or the downhole end) that promotes ease of installing the inner bearing sleeve 202 over the drive shaft 156 and over the metal compliance rings 208, 212, 216, 220. In an embodiment, the inner bearing sleeve 202 defines an inside shoulder 244 that accommodates structure in the rotor 154, for example a nut 240 that secures one end of the rotor 154 to the drive shaft 156. In another embodiment, however, the inner bearing sleeve 202 has a shape that does not include the tapered inside profile 242 and/or that does not include the inside shoulder 244. In an embodiment, a retaining ring 246 is disposed over the drive shaft 156 to stop the axial motion of the inner bearing sleeve 202 at one end. The retaining ring 246 may slide over the drive shaft 156 and locate in a circumferential groove defined by the outside surface of the drive shaft 156.

In an embodiment, a bearing spacing 252 is maintained between the outside of the inner bearing sleeve 202 and the inside of the outer bearing sleeve 204, for example when the inner bearing sleeve 202 and the outer bearing sleeve 204 are neutrally located. The inner bearing sleeve 202 and the outer bearing sleeve 204 operate as hydrodynamic bearings. When the electric motor 122 is turning, a thin oil film develops a force that keeps the outer surface of the inner bearing sleeve 202 from contacting the inner surface of the outer bearing sleeve 204. In an embodiment, the inside diameter of the outer bearing sleeve 204 is about 100 microns greater than the outside diameter of the inner bearing sleeve 202, establishing an average bearing spacing 252 of about 50 microns. In an embodiment, the bearing spacing 252 is between 300 microns and 20 microns. In an embodiment, the bearing spacing 252 is between 200 microns and 20 microns. In an embodiment, the bearing spacing 252 is between 150 microns and 20 microns. In an embodiment, the bearing spacing 252 is between 100 microns and 20 microns. In an embodiment, the bearing spacing 252 is between 80 microns and 20 microns. In an embodiment, the bearing spacing 252 is between 70 microns and 30 microns. In an embodiment, the bearing spacing 252 is between 40 microns and 60 microns. In an embodiment, the bearing spacing 252 is between 45 microns and 55 microns. In an embodiment, the bearing spacing 252 is between 48 microns and 52 microns.

During operation, however, the bearing spacing 252 may not be equal as the rotor 154 rotates. The compliance of the first plurality of metal compliance rings and the second plurality of metal compliance springs allow the inner bearing sleeve 202 and the outer bearing sleeve 204 to displace slightly to maintain a desired minimum bearing spacing 252 and to also keep the outside surface of the inner bearing sleeve 202 nearly parallel to the inside surface of the outer bearing sleeve 204. For example, as the bearing spacing 252 decreases at a given point, hydrodynamic forces of the oil film increases force—in some sense creating a wedge effect—pushing against the outside surface of the inner bearing sleeve 202 and against the inside surface of the outer bearing sleeve 204. The metal compliance rings respond to this increased hydrodynamic force by flexing, giving way, allowing the location of the bearing sleeves 202, 204 to slightly displace. In some cases, for example in the case of a transient disturbance force, the metal compliance rings operate to restore the positions of the bearing sleeves 202, 204 to their steady state or equilibrium position. In some cases, for example in the case of differential thermal expansion of different materials (e.g., the differential thermal expansion of the metal of the drive shaft 156 and the ceramic of the inner bearing sleeve 202 and/or the differential thermal expansion of the metal of the inner bore 248 of the rotor 152 and the ceramic of the outer bearing sleeve 204), the disturbance is not transitory, and the metal compliance rings operate to establish a different steady state or equilibrium position associated with the temperature of the operating environment.

A first separation 250 is established between the second circumferential groove 210 and the third circumferential groove 214. A second separation 254 is established between the sixth circumferential groove 224 and the seventh circumferential groove 228. As illustrated in FIG. 3, it is primarily the first set of metal compliance rings (e.g., metal compliance rings 208, 212, 216, 220) that provides tilt stabilization to the inner bearing sleeve 202 relative to the outer bearing sleeve 204 (e.g., keeps the outer surface of the inner bearing sleeve 202 axially parallel to the inner surface of the outer bearing sleeve 204). Reducing the first separation 250 promotes easier tilting of the inner bearing sleeve 202 versus the wider second separation 254 that makes tilting of the outer bearing sleeve 204 more unlikely. In another embodiment, however, the first spacing 250 could be greater than the second spacing 254, and it would be primarily the second set of metal compliance rings (e.g., metal compliance rings 222, 226, 230, 234) that provides tilt stabilization of the outer bearing sleeve 204 relative to the inner bearing sleeve 202. In an embodiment, it is preferred that only one of the inner bearing sleeve 202 or the outer bearing sleeve 204 be tilt stabilized relative to the other bearing sleeve, whereby to avoid undesired tilt oscillations.

The metal compliance rings 208, 212, 216, 220, 222, 226, 230, 234 may be made of any metal. In an embodiment, the metal compliance rings 208, 212, 216, 220, 222, 226, 230, 234 may be made of ELGILOY available commercially from Elgiloy Specialty Metals (ESM). ELGILOY is a metal that is an alloy of cobalt, chromium, and nickel. For example, ELGILOY may comprise 39% to 41% cobalt, 19% to 21% chromium, 14% to 16% nickel, 11.3% to 20.5% iron, 6% to 8% molybdenum, 1.5% to 2.5% manganese, and a maximum of 0.15% carbon. In an embodiment, the metal compliance rings 208, 212, 216, 220, 222, 226, 230, 234 may be made of INCONEL available commercially from Special Metals Corporation. INCONEL is an austenitic nickel-chromium-based steel. ELGILOY and INCONEL are known for retaining strength at high temperatures and for being corrosion resistant. In an embodiment, another alloy of cobalt, chromium, nickel, and iron other than ELGILOY may be used to make the metal compliance rings 208, 212, 216, 222, 226, 230, 234. In an embodiment, another austenitic nickel-chromium based steel other than INCONEL may be used to make the metal compliance rings 208, 212, 216, 222, 226, 230, 234. Notwithstanding, in some embodiments, yet other metals may be used in making the metal compliance rings 208, 212, 216, 222, 226, 230, 234, for example, for electric motors 122 intended for use in moderate temperature downhole environments.

In an embodiment, the metal compliance rings 208, 212, 216, 220, 222, 226, 230, 234 are springs that are joined at each end to form a continuous ring (e.g., garter springs), for example by welding the ends to each other or by some other joining method. Metal springs can be manufactured with predictable and/or engineered stiffness. In an embodiment, the metal compliance rings 208, 212, 216, 220, 222, 226, 230, 234 are made of round wire wound in a helical shape to form a spring whose ends are joined at each end to form a continuous ring. In an embodiment, the metal compliance rings 208, 212, 216, 220, 222, 226, 230, 234 are made of round wire wound to form a canted spring whose ends are joined at each end to form a continuous ring. In an embodiment, the metal compliance rings 208, 212, 216, 220, 222, 226, 230, 234 are made of flat wire or flat metal tape that is wound in a helical shape using on-edge coiling to form a spring whose ends are joined at each end to form a continuous ring. In an embodiment, the metal compliance rings 208, 212, 216, 220, 222, 226, 230, 234 are made of flat wire or flat metal tape that first has waves added to the flat wire and then is wound in a helical shape using on-edge coiling to form a wave spring whose ends are joined at each end to form a continuous ring. In an embodiment, the metal compliance rings 208, 212, 216, 220, 222, 226, 230, 234 are made of flat wire or flat metal tape that is wound in a helical shape using flat side coiling (e.g., as described in more detail below with reference to FIG. 4 and FIG. 5) to form a helical spring whose ends are joined at each end to form a continuous ring.

Figure 4:
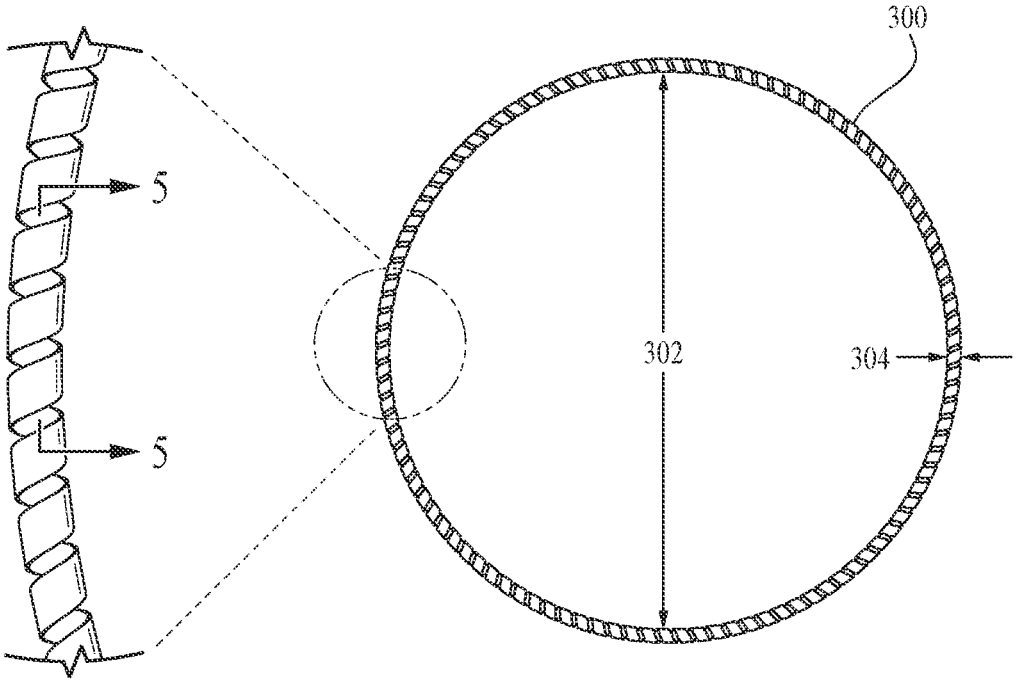
FIG. 4 is an illustration of a helical compliance spring according to an embodiment of the disclosure.
Figure 5:
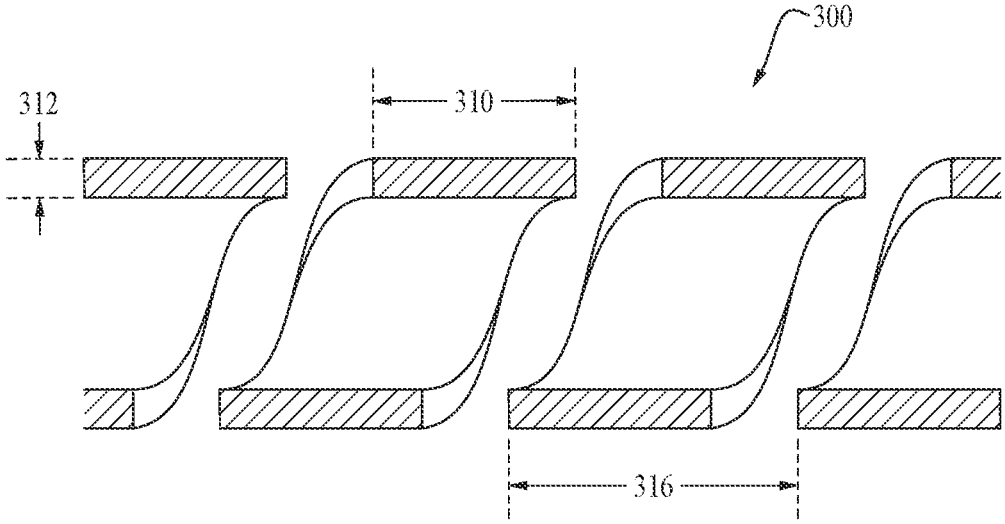
FIG. 5 is an illustration of some details of the helical compliance spring according to an embodiment of the disclosure.

Turning now to FIG. 4 and FIG. 5, a helical compliance spring 300 is described. The helical compliance spring 300 is a specific embodiment of the metal compliance rings discussed above with reference to FIG. 3. The helical compliance spring 300 has a ring diameter 302 and a helix diameter 304. The helical compliance spring 300 with the wide side of the flat metal tape aligned with the circumference of the helical compliance spring 300 tends to resist rolling over when subjected to torque and/or sideways forces directed along the circumference of the helical compliance spring 300.

In an embodiment, the ring diameter 302 may be about 0.4 inches. In an embodiment, the ring diameter 302 may be about 0.5 inches. In an embodiment, the ring diameter 302 may be about 0.625 inches. In an embodiment, the ring diameter 302 may be about 0.75 inches. In an embodiment, the ring diameter 302 may be about 0.875 inches. In an embodiment, the ring diameter 302 may be about 1.0 inches. In an embodiment, the ring diameter 302 may be about 1.25 inches. In an embodiment, the ring diameter 302 may be about 1.5 inches. In an embodiment, the ring diameter 302 may be about 1.75 inches. In an embodiment, the ring diameter 302 may be about 2.0 inches. In an embodiment, the ring diameter 302 is between 0.39 inches and 1.9 inches. In an embodiment, the ring diameter 302 is between 0.49 inches and 1.49 inches. In an embodiment, the ring diameter 302 is between 0.615 inches and 1.15 inches.

In an embodiment, the helix diameter 304 may be about 1 mm (millimeter). In an embodiment, the helix diameter 304 may be between 100 microns and 10 mm. In an embodiment, the helix diameter 304 may be between 250 microns and 7.5 mm. In an embodiment, the helix diameter 304 may be between 500 microns and 5 mm. In an embodiment, the helix diameter 304 may be between 700 microns and 3 mm. In an embodiment, the helix diameter 304 may be between 750 microns and 2 mm. In an embodiment the helix diameter 304 may be between 800 microns and 1.5 mm. In an embodiment, the helix diameter 304 may be between 850 microns and 1.2 mm. In an embodiment, the helix diameter 304 may be between 900 microns and 1.1 mm.

Turning now to FIG. 5, a cross-section across a centerline of the helix is described. The helical compliance spring 300 may be manufactured using a flat metal tape having a width 310 and a thickness 312. The flat metal tape may be ELGILOY, INCONEL, or another metal. The flat metal tape may comprise a metal alloy of cobalt, chromium, nickel, and iron. The flat metal tape may comprise an austenitic nickel-chromium based steel. The flat metal tape may be wound on a mandrel to form the helix. In an embodiment, the helix may be a right-handed helix. In another embodiment, the helix may be a left-handed helix.

In an embodiment, the thickness 312 may be about 160 microns. In an embodiment, the thickness 312 is between 50 microns and 450 microns. In an embodiment, the thickness 312 is between 100 microns and 220 microns. In an embodiment, the thickness 312 is between 130 microns and 190 microns. In an embodiment, the thickness 312 is between 150 microns and 170 microns. In an embodiment, the width 310 is about 900 microns. In an embodiment, the width 310 is between 250 microns and 2.5 mm. In an embodiment, the width 310 is between 500 microns and 1.5 mm. In an embodiment, the width 310 is between 750 microns and 1.2 mm. In an embodiment, the width 310 is between 800 microns and 1.0 mm. In an embodiment, the thickness 312 and the width 310 have about a 1:5 ratio. In an embodiment, the thickness 312 and the width 310 have a ratio between 1:15 and 1:3. In an embodiment, the thickness 312 and the width 310 have a ratio between 1:10 and 1:4. In an embodiment, the thickness 312 and the width 310 have a ratio between 1:8 and 1:4. In an embodiment, the thickness 312 and the width 310 have a ratio between 1:6 and 2:9.

In an embodiment, the helix is a circular helix. Note, however, that the helical compliance spring 300 that is initially circular may be deformed into a slightly elliptical profile when making an interference fit between the outside surface of the drive shaft 154 and the inside surface of the inner bearing sleeve 202 or between the outside surface of the outer bearing sleeve and the inside surface of the bore of the stator 152. Additionally, the helical compliance spring 300 that is initially circular may be deformed into a slightly more elliptical profile when flexing in response to radial forces and/or tilt forces. In an embodiment, the helical compliance spring 300 that is initially circular may be deformed into an elliptical profile exhibiting a ratio of about 2:3 between its short axis and its long axis. In an embodiment, the helical compliance spring 300 that is initially circular may be deformed into an elliptical profile exhibiting a ratio of about 3:4 between its short axis and its long axis. In an embodiment, the helical compliance spring 300 that is initially circular may be deformed into an elliptical profile exhibiting a ratio of about 4:5 between its short axis and its long axis. In an embodiment, the helical compliance spring 300 that is initially circular may be deformed into an elliptical profile exhibiting a ratio of about 5:6 between its short axis and its long axis. In an embodiment, the helical compliance spring 300 that is initially circular may be deformed into an elliptical profile exhibiting a ratio of about 6:7 between its short axis and its long axis. In an embodiment, the helical compliance spring 300 that is initially circular may be deformed into an elliptical profile exhibiting a ratio of about 7:8 between its short axis and its long axis.

The distance 316 is the distance between subsequent winds of the helix and is equal to the width 310 plus the separation between subsequent winds. By selecting the width 310 and the thickness 312 of a first metal tape and by adapting the helix diameter 304 and the distance 316, the spring properties of a first helical compliance spring 300 can be designed to have suitable properties for mounting the inner bearing sleeve 202. By selecting the width 310 and the thickness 312 of a second metal tape and by adapting the helix diameter 304 and distance 316, the spring properties of a second helical compliance spring 300 can be designed to have suitable properties for mounting the outer bearing sleeve 204.

The helical compliance spring 300 can be designed using rotor dynamics and structural analysis software applying finite element analysis techniques to specify the width 310 and the thickness 312 of the metal tape, the distance 316, the ring diameter 302, and the helix diameter 304 to obtain desired properties of the helical compliance spring 300 for a given bearing mounting system. In an embodiment, the design may be conducted in an iterative process, holding one or more design parameters fixed for an iteration while varying the remaining design parameters to find a final solution that is quasi-optimal. Part of the design process may involve avoiding high stresses, critical frequencies, and resonances related to operating the ESP electric motor 122 and/or related to the materials of the inner bearing sleeve 202 and of the outer bearing sleeve 204.

While the discussion above with reference to FIG. 1, FIG. 2, FIG. 3, FIG. 4, and FIG. 5 describes the use of metal compliance rings in mounting bearings in the electric motor 122, it will be appreciated that other rotating machinery in the ESP assembly 132 may also benefit from using metal compliance rings for mounting bearings. For example, metal compliance rings like those described above may advantageously be used to mount bearings in the seal section 124. Metal compliance rings like those described above may advantageously be used to mount bearings in the production pump assembly 128. Metal compliance rings like those described above may advantageously be used to mount bearings in a gas separator assembly.

Figure 6:
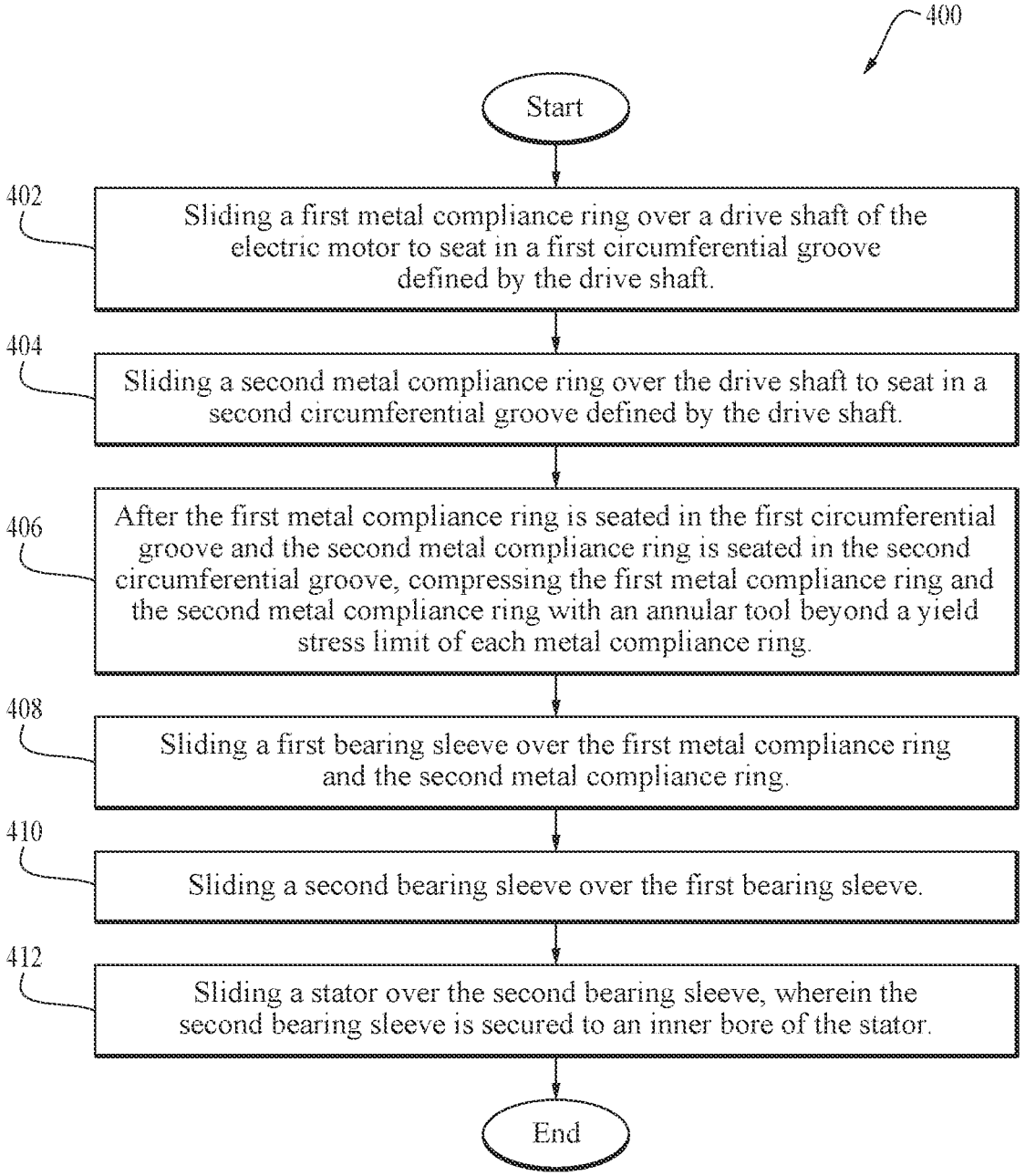
FIG. 6 is a flow chart of a method according to an embodiment of the disclosure.

Turning now to FIG. 6, a method 400 is described. In an embodiment, the method 400 is a method of assembling an electric submersible pump (ESP) electric motor. In an embodiment, the ESP electric motor is a permanent magnet motor (PMM). In another embodiment, the ESP electric motor is a conventional induction motor. In another embodiment, the ESP electric motor is a hybrid PMM.

At block 402, the method 400 comprises sliding a first metal compliance ring over a drive shaft of the electric motor to seat in a first circumferential groove defined by the drive shaft. At block 404, the method 400 comprises sliding a second metal compliance ring over the drive shaft to seat in a second circumferential groove defined by the drive shaft.

At block 406, the method 400 comprises, after the first metal compliance ring is seated in the first circumferential groove and the second metal compliance ring is seated in the second circumferential groove, compressing the first metal compliance ring and the second metal compliance ring with an annular tool beyond a yield stress limit of each metal compliance ring. Compressing the first metal compliance ring and the second metal compliance ring with the annular tool may establish a desired property of the rings to a tighter tolerance than the rings can be manufactured to by economically feasible manufacturing processes. In an embodiment, the first metal compliance ring and the second metal compliance ring comprise ELGILOY metal. In an embodiment, the first metal compliance ring and the second metal compliance ring comprise INCONEL metal. In an embodiment, the first metal compliance ring and the second metal compliance ring comprise a metal alloy of cobalt, chromium, nickel, and iron. In an embodiment, the first metal compliance ring and the second metal compliance ring comprise an austenitic nickel-chromium based steel.

In an embodiment, the method 400 further comprises sliding a third metal compliance ring over the drive shaft to seat in a third circumferential groove defined by the drive shaft, wherein compressing the first metal compliance ring and the second metal compliance ring with the annular tool further comprises compressing the third metal compliance ring with the annular tool beyond the yield stress limit of the third metal compliance ring. In an embodiment, the method 400 further comprises sliding a fourth metal compliance ring over the drive shaft to seat in a fourth circumferential groove defined by the drive shaft, wherein compressing the first metal compliance ring, the second metal compliance ring, and the third metal compliance ring with the annular tool further comprises compressing the fourth metal compliance ring with the annular tool beyond a yield stress limit of the fourth metal compliance ring. It is understood that the method 400 may comprise sliding more metal compliance rings over the drive shaft and compressing these additional metal compliance rings with the annular tool beyond their stress limits. In an embodiment, some of the metal compliance rings disposed over the drive shaft may have different properties and hence may be compressed with different annular tools during the assembly process.

At block 408, the method 400 comprises sliding a first bearing sleeve over the first metal compliance ring and the second metal compliance ring. After the processing of block 408 is completed, the first bearing sleeve may be said to be mounted, for example mounted by the first metal compliance ring and the second metal compliance ring (and optionally by additional metal compliance rings disposed between the drive shaft and the first bearing sleeve). After the processing of block 408, the metal compliance rings disposed between the drive shaft and the first bearing sleeve may be said to establish an interference fit. At block 410, the method 400 comprises sliding a second bearing sleeve over the first bearing sleeve. In an embodiment, the first bearing sleeve and the second bearing sleeve are made of ceramic material. In an embodiment, the first bearing sleeve and the second bearing sleeve are made of metal.

At block 412, the method 400 comprises sliding a stator over the second bearing sleeve, wherein the second bearing sleeve is secured to an inner bore of the stator. In an embodiment, the method 400 further comprises sliding a fifth metal compliance ring over an outside of the second bearing sleeve to seat in a fifth circumferential groove defined by an outside of the second bearing sleeve; and sliding a sixth metal compliance ring over the outside of the second bearing sleeve to seat in a sixth circumferential groove defined by the outside of the second bearing sleeve, wherein sliding the stator over the second bearing sleeve comprises sliding the stator over the fifth metal compliance ring and over the sixth metal compliance ring. In an embodiment, the method 400 further comprises sliding a seventh metal compliance ring over the outside of the second bearing sleeve to seat in a seventh circumferential groove defined by the outside of the second bearing sleeve, wherein sliding the stator over the second bearing sleeve further comprises sliding the stator over the seventh metal compliance ring. In an embodiment, the method 400 further comprises sliding an eighth metal compliance ring over the outside of the second bearing sleeve to seat in an eighth circumferential groove defined by the outside of the second bearing sleeve, wherein sliding the stator over the second bearing sleeve further comprises sliding the stator over the eighth metal compliance ring. It is understood that the processing of method 400 may comprise sliding more metal compliance rings over the second bearing sleeve. Any of the third, fourth, fifth, sixth, seventh, and/or eighth metal compliance ring may comprise ELGILOY metal. Any of the third, fourth, fifth, sixth, seventh, and/or eighth metal compliance ring may comprise INCONEL. Any of the third, fourth, fifth, sixth, seventh, and/or eighth metal compliance ring may comprise a metal alloy of cobalt, chromium, nickel, and iron. Any of the third, fourth, fifth, sixth, seventh, and/or eighth metal compliance ring may comprise an austenitic nickel-chromium based steel. While the description of the method 400 above has been articulated with reference to an electric motor, it will be appreciated that method 400 is easily adapted to a method of assembling a seal section of an ESP assembly, to a method of assembling a gas separator of an ESP assembly, and/or to a method of assembling a production pump assembly of an ESP assembly.

Figure 7:
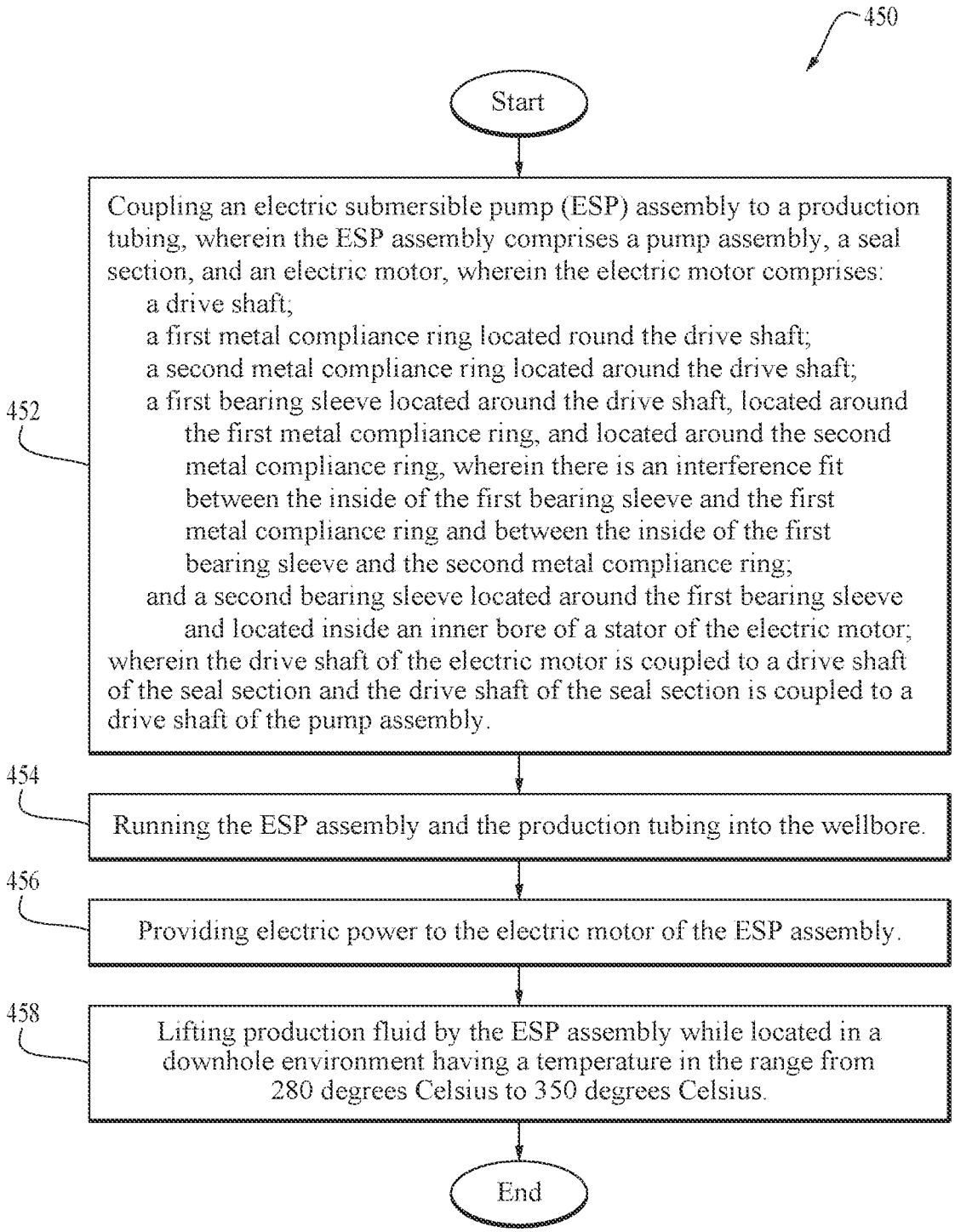
FIG. 7 is a flow chart of a method according to an embodiment of the disclosure.

Turning now to FIG. 7, a method 450 is described. In an embodiment, the method 450 is a method of lifting a production fluid in a wellbore. In an embodiment, the method of 450 is performed, at least in part, by operating the electric motor 122 described above having bearings mounted using metal compliance rings as described above with reference to FIG. 1, FIG. 2, FIG. 3, FIG. 4, FIG. 5, and/or FIG. 6. At block 452, the method 450 comprises coupling an electric submersible pump (ESP) assembly to a production tubing, wherein the ESP assembly comprises a pump assembly, a seal section, and an electric motor. The electric motor comprises a drive shaft, a first metal compliance ring located around the drive shaft; a second metal compliance ring located around the drive shaft, a first bearing sleeve located around the drive shaft, located around the first metal compliance ring, and located around the second metal compliance ring, wherein there is an interference fit between the inside of the first bearing sleeve and the first metal compliance ring and between the inside of the first bearing sleeve and the second metal compliance ring, and a second bearing sleeve located around the first bearing sleeve and located inside an inner bore of a stator of the electric motor. The drive shaft of the electric motor is coupled to a drive shaft of the seal section and the drive shaft of the seal section is coupled to a drive shaft of the pump assembly.

At block 454, the method 450 comprises running the ESP assembly and the production tubing into the wellbore.

At block 456, the method 450 comprises providing electric power to the electric motor of the ESP assembly. At block 458, the method 450 comprises lifting production fluid by the ESP assembly while located in a downhole environment having a temperature in the range from 280 degrees Celsius to 350 degrees Celsius. In an embodiment, the processing of block 458 of method 450 comprises lifting production fluid by the ESP assembly while located in a downhole environment having a temperature in the range of 280 degrees Celsius to 400 degrees Celsius, in the range of 280 degrees Celsius to 450 degrees Celsius, in the range of 280 degrees Celsius to 500 degrees Celsius, or in the range of 280 degrees Celsius to 550 degrees Celsius. In an embodiment, a high temperature limitation for operation of the ESP assembly may be established not by the metal compliance rings, by the first bearing sleeve, and the second bearing sleeve but instead by other components in the electric motor such as the dielectric oil in the electric motor.

The downhole environment may have a high temperature continuously or the temperature may reach into the high temperature range under certain infrequent but notwithstanding predictable circumstances. For example, in a SAGD downhole environment, temperature may remain in a first temperature range during normal operations, but when steam undesirably breaks into the main production wellbore (e.g., passes from the steam bearing wellbore parallel into the production wellbore), the downhole temperature may enter into a second higher temperature range. While steam breaking into the main production wellbore (e.g., into wellbore 102 of FIG. 1) may be infrequent, it can be expected to happen from time to time, and it may be desirable under this eventuality that the ESP electric motor 122 be able to survive and operate in this circumstance. In a geothermal production environment, the downhole temperature may remain continuously in a high temperature range.

In an embodiment, the method 450 further comprises tilting the first bearing sleeve by the first metal compliant ring and the second metal compliant ring to maintain an outside surface of the first bearing sleeve parallel with an inside surface of the second bearing sleeve. In an embodiment, the first bearing sleeve and the second bearing sleeve of method 450 comprise ceramic materials (e.g., the first bearing sleeve is ceramic and the second bearing sleeve is ceramic), and the method 450 further comprises maintaining an axial alignment of the first bearing sleeve with the second bearing sleeve by the first metal compliance ring and the second metal compliance ring in the presence of an unequal heat growth in the drive shaft and in the first bearing sleeve. Said in other words, the first metal compliance ring and the second metal compliance ring may flex whereby to take-up the excess heat growth in the metal drive shaft without displacing the first bearing sleeve relative to the second bearing sleeve.

While the description of the method 450 above has been articulated with reference to an electric motor, it will be appreciated that that method 450 is easily adapted to a method of lifting production fluid in a wellbore by operating a seal section of an ESP assembly having bearings mounted using metal compliance rings, by operating a gas separator of an ESP assembly having bearings mounted using metal compliance rings, by operating a pump assembly having bearings mounted using metal compliance rings, and/or by operating an electric motor having bearings mounted using metal compliance rings.

Additional Disclosure

The following are non-limiting, specific embodiments in accordance with the present disclosure.

A first embodiment, which is a component of an electric submersible pump (ESP) assembly, comprising a drive shaft, a first metal compliance ring located around the drive shaft; a second metal compliance ring located around the drive shaft; a first bearing sleeve located around the drive shaft, located around the first metal compliance ring, and located around the second metal compliance ring, wherein there is an interference fit between the inside of the first bearing sleeve and the first metal compliance ring and between the inside of the first bearing sleeve and the second metal compliance ring; and a second bearing sleeve located around the first bearing sleeve and located within a housing of the component of the ESP assembly.

A second embodiment, which is the component of the ESP assembly of the first embodiment, wherein the component is an electric motor, a seal section, a gas separator, or a production pump assembly.

A third embodiment, which is the first embodiment of the second embodiment, wherein an outside surface of the drive shaft defines a first circumferential groove and a second circumferential groove, the first metal compliance ring is located in the first circumferential groove, and the second metal compliance ring is located in the second circumferential groove.

A fourth embodiment, which is the third embodiment, further comprising a third metal compliance ring located around the drive shaft and a fourth metal compliance ring located around the drive shaft, wherein the first bearing sleeve is located around the third metal compliance ring and located around the fourth metal compliance ring, wherein the outside surface of the drive shaft defines a third circumferential groove and a fourth circumferential groove, and wherein the third metal compliance ring is located in the third circumferential groove, and the fourth metal compliance ring is located in the fourth circumferential groove.

A fifth embodiment, which is any of the first through the fourth embodiment, wherein the first bearing sleeve and the second bearing sleeve comprise ceramic material.

A sixth embodiment, which is any of the first through the fourth embodiment, wherein the first bearing sleeve and the second bearing sleeve comprise metal material.

A seventh embodiment, which is any of the first through the sixth embodiment, wherein the first metal compliance ring and the second metal compliance ring comprise a metal alloy comprising cobalt, chromium, nickel, and iron or an austenitic nickel-chromium steel.

An eighth embodiment, which is any of the first through the seventh embodiment, wherein the first metal compliance ring is a first garter spring and the second metal compliance ring is a second garter spring.

A ninth embodiment, which is the eighth embodiment, wherein the first metal compliance ring and the second metal compliance ring each comprise a helical round wire spring, a helical canted round wire spring, or a helical flat metal spring using on-edge coiling.

A tenth embodiment, which is any of the first through the seventh embodiment, wherein the first metal compliance ring is a helical flat metal spring wherein a first end of the spring is fixed to a second end of the spring to form a ring.

An eleventh embodiment, which is any of the first through the seventh embodiment, wherein the first metal compliance ring is a helical flat metal spring wherein a first end of the spring is fixed to a second end of the spring to form a ring as illustrated in FIG. 4 and FIG. 5.

A twelfth embodiment, which is any of the first through the eleventh embodiment, wherein a spacing between the first metal compliance ring and the second metal compliance ring is configured to provide tilt compliance to maintain an outside surface of the first bearing sleeve parallel to an inside surface of the second bearing sleeve.

A thirteenth embodiment, which is the twelfth embodiment, wherein the first metal compliance ring and the second metal compliance ring are configured to provide radial compliance to radially stabilize the first bearing sleeve.

A fourteenth embodiment, which is any of the first through the eleventh embodiment, wherein the first metal compliance ring and the second metal compliance ring are configured to provide radial compliance to radially stabilize the first bearing sleeve.

A fifteenth embodiment, which is any of the first through the fourteenth embodiment, wherein an outside surface of the second bearing sleeve defines a fifth circumferential groove and a sixth circumferential groove, and further comprising a fifth metal compliance ring located around the outside of the second bearing sleeve in the fifth circumferential groove and a sixth metal compliance ring located around the outside of the second bearing sleeve in the sixth circumferential groove.

A sixteenth embodiment, which is the fifteenth embodiment, wherein the fifth metal compliance ring and the sixth metal compliance ring are configured to provide radial compliance to radially stabilize the second bearing sleeve.

A seventeenth embodiment, which is the sixteenth embodiment, wherein the outside surface of the second bearing sleeve defines a seventh circumferential groove and an eighth circumferential groove, and further comprising a seventh metal compliance ring located around the outside of the second bearing sleeve in the seventh circumferential groove and an eighth metal compliance ring located around the outside of the second bearing sleeve in the eighth circumferential groove.

An eighteenth embodiment, which is any of the fifteenth through the seventeenth embodiment, wherein the fifth metal compliance ring and the sixth metal compliance ring provide anti-rotational support for the second bearing sleeve.

A nineteenth embodiment, which is any of the fifteenth through the eighteenth embodiment, wherein a spacing between the fifth metal compliance ring and the sixth metal compliance ring is configured to provide tilt compliance to maintain an inside surface of the second bearing sleeve parallel to an outside surface of the first bearing sleeve.

A twentieth embodiment, which is any of the first through the nineteenth embodiment, wherein the first metal compliance ring and the second metal compliance ring provide anti-rotational support to the first bearing sleeve.

A twenty-first embodiment, which is any of the first through the twentieth embodiment, wherein the outside surface of the drive shaft defines a first longitudinal groove and the inside surface of the first bearing sleeve defines a longitudinal groove, and further comprising a first key that is located between the outside surface of the drive shaft and the inside surface of the first bearing sleeve in the first and second longitudinal grooves.

A twenty-second embodiment, which is any of the first through the twentieth-first embodiment, wherein the inside surface of the inner bore of the stator defines a third longitudinal groove and the outside surface of the second bearing sleeve defines a fourth longitudinal groove, and further comprising a second key that is located between the inside surface of the inner bore of the stator and the outside surface of the second bearing sleeve in the third and fourth longitudinal grooves.

A seventeenth embodiment, which is any of the first through the sixteenth embodiment, A twenty-third embodiment, which is an electric submersible pump (ESP) electric motor, comprising a drive shaft; a first metal compliance ring located around the drive shaft; a second metal compliance ring located around the drive shaft; a first bearing sleeve located around the drive shaft, located around the first metal compliance ring, and located around the second metal compliance ring, wherein there is an interference fit between the inside of the first bearing sleeve and the first metal compliance ring and between the inside of the first bearing sleeve and the second metal compliance ring; and a second bearing sleeve located around the first bearing sleeve and located inside an inner bore of a stator of the electric motor.

A twenty-fourth embodiment, which is the twenty-third embodiment, wherein an outside surface of the drive shaft defines a first circumferential groove and a second circumferential groove, the first metal compliance ring is located in the first circumferential groove, and the second metal compliance ring is located in the second circumferential groove.

A twenty-fifth embodiment, which is the twenty-third or the twenty-fourth embodiment, wherein the first bearing sleeve and the second bearing sleeve comprise ceramic material.

A twenty-sixth embodiment, which is the twenty-third or the twenty-fourth embodiment, wherein the first bearing sleeve and the second bearing sleeve comprise metal material.

A twenty-seventh embodiment, which is any of the twenty-third through the twenty-fifth embodiment, wherein the first metal compliance ring and the second metal compliance ring comprise a metal alloy comprising cobalt, chromium, nickel, and iron or an austenitic nickel-chromium steel.

A twenty-eighth embodiment, which is any of the twenty-third through the twenty-fifth embodiment, wherein the first metal compliance ring is a first garter spring and the second metal compliance ring is a second garter spring.

A twenty-ninth embodiment, which is the twenty-eighth embodiment, wherein the first metal compliance ring and the second metal compliance ring each comprise a helical round wire spring, a helical canted round wire spring, or a helical flat metal spring using on-edge coiling.

A thirtieth embodiment, which is any of the twenty-third through the twenty-eighth embodiment, wherein the first metal compliance ring is a helical flat metal spring wherein a first end of the spring is fixed to a second end of the spring to form a ring.

A thirty-first embodiment, which is any of the twenty-third through the thirtieth embodiment, wherein a spacing between the first metal compliance ring and the second metal compliance ring is configured to provide tilt compliance to maintain an outside surface of the first bearing sleeve parallel to an inside surface of the second bearing sleeve.

A thirty-second embodiment, which his any of the twenty-third through the thirty-first embodiment, wherein the first metal compliance ring and the second metal compliance ring are configured to provide radial compliance to radially stabilize the inner bearing sleeve.

A thirty-third embodiment, which is the thirty-second embodiment, wherein an outside surface of the second bearing sleeve defines a third circumferential groove and a fourth circumferential groove, and further comprising a third metal compliance ring located around the outside of the second bearing sleeve in the third circumferential groove and a fourth metal compliance ring located around the outside of the second bearing sleeve in the fourth circumferential groove.

A thirty-fourth embodiment, which is the thirty-third embodiment, wherein the third metal compliance ring and the fourth metal compliance ring are configured to provide radial compliance to radially stabilize the outer bearing sleeve.

A thirty-fifth embodiment, which is any of the twenty-third through thirty-fourth embodiment, further comprising a fifth metal compliance ring located around the drive shaft and a sixth metal compliance ring located around the drive shaft.

A thirty-sixth embodiment, which is any of the twenty-third through thirty-fifth embodiment, wherein the first metal compliance ring and the second metal compliance ring provide anti-rotational support to the first bearing sleeve.

A thirty-seventh embodiment, which is a method of assembling a component of an electric submersible pump (ESP) electric motor, comprising sliding a first metal compliance ring over a drive shaft of the component to seat in a first circumferential groove defined by the drive shaft; sliding a second metal compliance ring over the drive shaft to seat in a second circumferential groove defined by the drive shaft; after the first metal compliance ring is seated in the first circumferential groove and the second metal compliance ring is seated in the second circumferential groove, compressing the first metal compliance ring and the second metal compliance ring with an annular tool beyond a yield stress limit of each metal compliance ring; sliding a first bearing sleeve over the first metal compliance ring and the second metal compliance ring; sliding a second bearing sleeve over the first bearing sleeve.

A thirty-eighth embodiment, which is the thirty-seventh embodiment, wherein the component is an electric motor, a seal section, a gas separator, or a production pump assembly.

A thirty-ninth embodiment, which is the thirty-seventh embodiment or the thirty-eighth embodiment, further comprising sliding a housing over the second bearing sleeve.

A fortieth embodiment, which is the thirty-seventh embodiment, wherein the component is an electric motor and further comprising sliding a stator over the second bearing sleeve, wherein the second bearing sleeve is secured to an inner bore of the stator.

A forty-first embodiment, which is any of the thirty-seventh through fortieth embodiment, further comprising sliding a third metal compliance ring over the drive shaft to seat in a third circumferential groove defined by the drive shaft; and sliding a sliding a fourth metal compliance ring over the drive shaft to seat in a fourth circumferential groove defined by the drive shaft, wherein the compressing the first metal compliance ring and the second metal compliance ring with the annular tool further comprises compressing the third metal compliance ring and the fourth metal compliance ring beyond a yield stress limit of the third metal compliance ring and of the fourth metal compliance ring.

A forty-second embodiment, which is any of the thirty-seventh through forty-first embodiment, further comprising sliding a fifth metal compliance ring over an outside of the second bearing sleeve to seat in a fifth circumferential groove defined by an outside of the second bearing sleeve; and sliding a sixth metal compliance ring over the outside of the second bearing sleeve to seat in a sixth circumferential groove defined by the outside of the second bearing sleeve, wherein sliding the stator over the second bearing sleeve comprises sliding the stator over the fifth metal compliance ring and over the sixth metal compliance ring.

A forty-third embodiment, which is any of the thirty-seventh through forty-second embodiment, wherein the component is a permanent magnet motor.

A forty-fourth embodiment, which is a method of assembling an electric submersible pump (ESP) electric motor, comprising sliding a first metal compliance ring over a drive shaft of the electric motor to seat in a first circumferential groove defined by the drive shaft; sliding a second metal compliance ring over the drive shaft to seat in a second circumferential groove defined by the drive shaft; after the first metal compliance ring is seated in the first circumferential groove and the second metal compliance ring is seated in the second circumferential groove, compressing the first metal compliance ring and the second metal compliance ring with an annular tool beyond a yield stress limit of each metal compliance ring; sliding a first bearing sleeve over the first metal compliance ring and the second metal compliance ring; sliding a second bearing sleeve over the first bearing sleeve; and sliding a stator over the second bearing sleeve, wherein the second bearing sleeve is secured to an inner bore of the stator.

A forty-fifth embodiment, which is the forty-fourth embodiment, further comprising sliding a third metal compliance ring over the drive shaft to seat in a third circumferential groove defined by the drive shaft; and sliding a sliding a fourth metal compliance ring over the drive shaft to seat in a fourth circumferential groove defined by the drive shaft, wherein the compressing the first metal compliance ring and the second metal compliance ring with the annular tool further comprises compressing the third metal compliance ring and the fourth metal compliance ring beyond a yield stress limit of the third metal compliance ring and of the fourth metal compliance ring.

A forty-sixth embodiment, which is the forty-fourth or forty-fifth embodiment, further comprising sliding a fifth metal compliance ring over an outside of the second bearing sleeve to seat in a fifth circumferential groove defined by an outside of the second bearing sleeve; and sliding a sixth metal compliance ring over the outside of the second bearing sleeve to seat in a sixth circumferential groove defined by the outside of the second bearing sleeve, wherein sliding the stator over the second bearing sleeve comprises sliding the stator over the fifth metal compliance ring and over the sixth metal compliance ring.

A forty-seventh embodiment, which is any of the forty-fourth through forty-sixth embodiment, wherein the ESP electric motor is a permanent magnet motor.

A forty-eighth embodiment, which is a method of lifting a production fluid in a wellbore, comprising coupling an electric submersible pump (ESP) assembly to a production tubing, wherein the ESP assembly comprises a pump assembly, a seal section, and an electric motor, wherein the pump assembly, the seal section, or the electric motor comprises a drive shaft, a first metal compliance ring located round the drive shaft, a second metal compliance ring located around the drive shaft, a first bearing sleeve located around the drive shaft, located around the first metal compliance ring, and located around the second metal compliance ring, wherein there is an interference fit between an inside of the first bearing sleeve and the first metal compliance ring and between the inside of the first bearing sleeve and the second metal compliance ring, and a second bearing sleeve located around the first bearing sleeve and located inside a housing of the pump assembly, the seal section, or the electric motor; running the ESP assembly and the production tubing into the wellbore; providing electric power to the electric motor of the ESP assembly; and lifting production fluid by the ESP assembly while located in a downhole environment having a temperature in the range from 280 degrees Celsius to 350 degrees Celsius.

A forty-ninth embodiment, which is the forty-eighth embodiment, further comprising tilting the first bearing sleeve by the first metal compliant ring and the second metal compliant ring to maintain an outside surface of the first bearing sleeve parallel with an inside surface of the second bearing sleeve.

A fiftieth embodiment, which is the forty-eighth or the forty-ninth embodiment, wherein the first bearing sleeve and the second bearing sleeve comprise ceramic material and further comprising maintaining an axial alignment of the first bearing sleeve with the second bearing sleeve by the first metal compliance ring and the second metal compliance ring in the presence of an unequal heat growth in the drive shaft and in the first bearing sleeve.

A fifty-first embodiment, which is the forty-eighth or the forty-ninth embodiment, wherein the first bearing sleeve and the second bearing sleeve comprise metal material.

A fifty-second embodiment, which is any of the forty-eighth through fifty-first embodiment, wherein the electric motor is a permanent magnet motor (PMM).

A fifty-third embodiment, which is a method of lifting a production fluid in a wellbore, comprising coupling an electric submersible pump (ESP) assembly to a production tubing, wherein the ESP assembly comprises a pump assembly, a seal section, and an electric motor, wherein the electric motor comprises a drive shaft, a first metal compliance ring located round the drive shaft, a second metal compliance ring located around the drive shaft, a first bearing sleeve located around the drive shaft, located around the first metal compliance ring, and located around the second metal compliance ring, wherein there is an interference fit between an inside of the first bearing sleeve and the first metal compliance ring and between the inside of the first bearing sleeve and the second metal compliance ring, and a second bearing sleeve located around the first bearing sleeve and located inside an inner bore of a stator of the electric motor, wherein the drive shaft of the electric motor is coupled to a drive shaft of the seal section and the drive shaft of the seal section is coupled to a drive shaft of the pump assembly; running the ESP assembly and the production tubing into the wellbore; providing electric power to the electric motor of the ESP assembly; and lifting production fluid by the ESP assembly while located in a downhole environment having a temperature in the range from 280 degrees Celsius to 350 degrees Celsius.

A fifty-fourth embodiment, which is the fifty-third embodiment, further comprising tilting the first bearing sleeve by the first metal compliant ring and the second metal compliant ring to maintain an outside surface of the first bearing sleeve parallel with an inside surface of the second bearing sleeve.

A fifty-fifth embodiment, which is the fifty-third or the fifty-fourth embodiment, wherein the first bearing sleeve and the second bearing sleeve comprise ceramic material and further comprising maintaining an axial alignment of the first bearing sleeve with the second bearing sleeve by the first metal compliance ring and the second metal compliance ring in the presence of an unequal heat growth in the drive shaft and in the first bearing sleeve.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. An electric submersible pump (ESP) electric motor, comprising:

a drive shaft;

a first metal compliance ring located around the drive shaft, wherein the first metal compliance ring is a helical flat metal spring;

a second metal compliance ring located around the drive shaft, wherein the second metal compliance ring is a helical flat metal spring;

a first bearing sleeve located around the drive shaft, located around the first metal compliance ring, and located around the second metal compliance ring, wherein there is an interference fit between the inside of the first bearing sleeve and the first metal compliance ring and between the inside of the first bearing sleeve and the second metal compliance ring; and a second bearing sleeve located around the first bearing sleeve and located inside an inner bore of a stator of the electric motor.

2. The ESP electric motor of claim 1, wherein an outside surface of the drive shaft defines a first circumferential groove and a second circumferential groove, the first metal compliance ring is located in the first circumferential groove, and the second metal compliance ring is located in the second circumferential groove.

3. The ESP electric motor of claim 1, wherein the first bearing sleeve and the second bearing sleeve comprise ceramic material.

4. The ESP electric motor of claim 1, wherein the first metal compliance ring and the second metal compliance ring comprise a metal alloy comprising cobalt, chromium, nickel, and iron or an austenitic nickel-chromium steel.

5. The ESP electric motor of claim 1, wherein a spacing between the first metal compliance ring and the second metal compliance ring is configured to provide tilt compliance to maintain an outside surface of the first bearing sleeve parallel to an inside surface of the second bearing sleeve.

6. The ESP electric motor of claim 5, wherein the first metal compliance ring and the second metal compliance ring are configured to provide radial compliance to radially stabilize the first bearing sleeve.

7. The ESP electric motor of claim 6, wherein an outside surface of the second bearing sleeve defines a third circumferential groove and a fourth circumferential groove, and further comprising a third metal compliance ring located around the outside of the second bearing sleeve in the third circumferential groove and a fourth metal compliance ring located around the outside of the second bearing sleeve in the fourth circumferential groove.

8. The ESP electric motor of claim 7, wherein the third metal compliance ring and the fourth metal compliance ring are configured to provide radial compliance to radially stabilize the second bearing sleeve.

9. The ESP electric motor of claim 1, further comprising a fifth metal compliance ring located around the drive shaft and a sixth metal compliance ring located around the drive shaft.

10. The ESP electric motor of claim 1, wherein the first metal compliance ring and the second metal compliance ring provide anti-rotational support to the first bearing sleeve.

11. A method of assembling an electric submersible pump (ESP) electric motor, comprising:

sliding a first metal compliance ring over a drive shaft of the electric motor to seat in a first circumferential groove defined by the drive shaft, wherein the first metal compliance ring is a helical flat metal spring;

sliding a second metal compliance ring over the drive shaft to seat in a second circumferential groove defined by the drive shaft, wherein the second metal compliance ring is a helical flat metal spring;

after the first metal compliance ring is seated in the first circumferential groove and the second metal compliance ring is seated in the second circumferential groove, compressing the first metal compliance ring and the second metal compliance ring with an annular tool beyond a yield stress limit of each metal compliance ring;

sliding a first bearing sleeve over the first metal compliance ring and the second metal compliance ring to form an interference fit between the inside of the first bearing sleeve and the first metal compliance ring and between the inside of the first bearing sleeve and the second metal compliance ring;

sliding a second bearing sleeve over the first bearing sleeve; and sliding a stator over the second bearing sleeve, wherein the second bearing sleeve is secured to an inner bore of the stator.

12. The method of claim 11, further comprising:

sliding a third metal compliance ring over the drive shaft to seat in a third circumferential groove defined by the drive shaft; and sliding a sliding a fourth metal compliance ring over the drive shaft to seat in a fourth circumferential groove defined by the drive shaft, wherein the compressing the first metal compliance ring and the second metal compliance ring with the annular tool further comprises compressing the third metal compliance ring and the fourth metal compliance ring beyond a yield stress limit of the third metal compliance ring and of the fourth metal compliance ring.

13. The method of claim 11, further comprising:

sliding a fifth metal compliance ring over an outside of the second bearing sleeve to seat in a fifth circumferential groove defined by an outside of the second bearing sleeve; and sliding a sixth metal compliance ring over the outside of the second bearing sleeve to seat in a sixth circumferential groove defined by the outside of the second bearing sleeve, wherein sliding the stator over the second bearing sleeve comprises sliding the stator over the fifth metal compliance ring and over the sixth metal compliance ring.

14. The method of claim 11, wherein the ESP electric motor is a permanent magnet motor.

15. A method of lifting a production fluid in a wellbore, comprising:

coupling an electric submersible pump (ESP) assembly to a production tubing, wherein the ESP assembly comprises a pump assembly, a seal section, and an electric motor, wherein the electric motor comprises a drive shaft, a first metal compliance ring located round the drive shaft, wherein the first metal compliance ring is a helical flat metal spring, a second metal compliance ring located around the drive shaft, wherein the second metal compliance ring is a helical flat metal spring, a first bearing sleeve located around the drive shaft, located around the first metal compliance ring, and located around the second metal compliance ring, wherein there is an interference fit between an inside of the first bearing sleeve and the first metal compliance ring and between the inside of the first bearing sleeve and the second metal compliance ring, and a second bearing sleeve located around the first bearing sleeve and located inside an inner bore of a stator of the electric motor, wherein the drive shaft of the electric motor is coupled to a drive shaft of the seal section and the drive shaft of the seal section is coupled to a drive shaft of the pump assembly;

running the ESP assembly and the production tubing into the wellbore;

providing electric power to the electric motor of the ESP assembly; and lifting production fluid by the ESP assembly while located in a downhole environment having a temperature in the range from 280 degrees Celsius to 350 degrees Celsius.

16. The method of claim 15, further comprising tilting the first bearing sleeve by the first metal compliant ring and the second metal compliant ring to maintain an outside surface of the first bearing sleeve parallel with an inside surface of the second bearing sleeve.

17. The method of claim 15, wherein the first bearing sleeve and the second bearing sleeve comprise ceramic material and further comprising maintaining an axial alignment of the first bearing sleeve with the second bearing sleeve by the first metal compliance ring and the second metal compliance ring in the presence of an unequal heat growth in the drive shaft and in the first bearing sleeve.

18. The ESP electric motor of claim 1, wherein the first metal compliance ring is a helical flat metal spring using flat side coiling and the second metal compliance ring is a helical flat metal spring using flat side coiling.

19. The ESP electric motor of claim 1, wherein the first metal compliance ring is a helical flat metal spring using on-edge coiling and the second metal compliance ring is a helical flat metal spring using on-edge coiling.

20. The ESP electric motor of claim 1, wherein the first metal compliance ring is a helical flat metal wave spring and the second metal compliance ring is a helical flat metal wave spring.

* * * * *